US010921079B1

(12) United States Patent
Full

(10) Patent No.: US 10,921,079 B1
(45) Date of Patent: Feb. 16, 2021

(54) MAGAZINE RETENTION DEVICE WITH INTEGRATED AIMING SYSTEM

(71) Applicant: Full Forward Technologies, LLC, Henderson, NV (US)

(72) Inventor: Michael Full, Dublin, CA (US)

(73) Assignee: Full Forward Technologies, LLC, Henderson, NV (US)

( * ) Notice: Subject to any disclaimer, the term of this patent is extended or adjusted under 35 U.S.C. 154(b) by 0 days.

(21) Appl. No.: 16/745,399

(22) Filed: Jan. 17, 2020

Related U.S. Application Data

(60) Provisional application No. 62/794,705, filed on Jan. 21, 2019.

(51) Int. Cl.

| | |
|---|---|
| ***F41A 17/38*** | (2006.01) |
| ***F41G 11/00*** | (2006.01) |
| *F41G 1/06* | (2006.01) |
| *F41G 1/02* | (2006.01) |

(52) U.S. Cl.
CPC ..... *F41A 17/38* (2013.01); *F41G 11/003* (2013.01); *F41G 1/02* (2013.01); *F41G 1/06* (2013.01)

(58) Field of Classification Search
CPC ..... F41A 17/38; F41G 11/003; F41G 1/02; F41G 1/06
USPC ..... 42/111
See application file for complete search history.

(56) References Cited

U.S. PATENT DOCUMENTS 4,115,943 A * 9/1978 Musgrave ..... F41A 9/63 42/71.01
4,484,404 A * 11/1984 Johnson ..... F41A 17/38 42/90
4,597,213 A * 7/1986 Musgrave ..... F41C 27/00 42/90
4,799,323 A * 1/1989 Musgrave ..... F41A 17/38 42/90
6,154,997 A * 12/2000 Aluotto ..... F41C 33/02 224/239
6,698,129 B1 * 3/2004 Hanks ..... F41A 9/63 42/90
D689,581 S * 9/2013 Fitzpatrick ..... F41A 9/63 D22/108
8,640,374 B1 * 2/2014 Reichelt ..... F41C 27/00 42/90
8,739,451 B2 * 6/2014 Nelson ..... F41A 9/63 42/90
8,887,972 B2 * 11/2014 Solomon ..... A45F 5/021 224/245
9,175,923 B2 * 11/2015 Ruby ..... F41A 9/64
(Continued)

*Primary Examiner* — Joshua E Freeman

(74) *Attorney, Agent, or Firm* — Shaddock Law Group, PC

(57) ABSTRACT

A magazine retention device, including at least some of a body portion that extends along a longitudinal axis of the body portion, wherein at least one cavity is defined within the body portion, wherein the at least one cavity is operable to receive at least a portion of a magazine at least partially therein, wherein a front sight extends from the body portion and a rear sight extends from the body portion, and wherein the front sight and the rear sight are aligned substantially parallel to the longitudinal axis of the magazine retention device; and an attachment portion that extends from the body portion to allow the magazine retention device to be attached or coupled to a rail element, such that the longitudinal axis of the magazine retention device is substantially parallel to a longitudinal axis of the rail element.

20 Claims, 19 Drawing Sheets

(56) References Cited

U.S. PATENT DOCUMENTS

| | | | | |
|---|---|---|---|---|
| D773,588 | S * | 12/2016 | Wasankari | D22/108 |
| 9,581,400 | B2 * | 2/2017 | Dove | F41A 9/65 |
| 9,921,036 | B2 * | 3/2018 | Gravelle | F41G 11/001 |
| 10,094,635 | B2 * | 10/2018 | Holmes | F41C 23/14 |
| 2009/0293334 | A1 * | 12/2009 | Swan | F41C 33/007 42/90 |
| 2010/0263255 | A1 * | 10/2010 | Harris | F41C 27/00 42/90 |
| 2011/0030258 | A1 * | 2/2011 | Fistikchi | F41C 23/22 42/1.06 |
| 2011/0107645 | A1 * | 5/2011 | Faifer | F41A 9/63 42/90 |
| 2012/0311911 | A1 * | 12/2012 | Nelson | F41A 9/63 42/90 |
| 2014/0053385 | A1 * | 2/2014 | Nielsen-Cole | F42B 39/02 29/426.1 |
| 2015/0308790 | A1 * | 10/2015 | Gravelle | F41C 27/00 42/90 |
| 2016/0265872 | A1 * | 9/2016 | Tarazi | F41C 27/00 |
| 2016/0313078 | A1 * | 10/2016 | Dove | F41A 9/68 |
| 2017/0146318 | A1 * | 5/2017 | Plummer | F41G 1/01 |
| 2017/0153084 | A1 * | 6/2017 | Tarazi | F41C 23/12 |
| 2017/0160048 | A1 * | 6/2017 | Galletta, II | F41A 3/66 |
| 2017/0227311 | A1 * | 8/2017 | Dove | F41A 9/01 |
| 2017/0328657 | A9 * | 11/2017 | Dove | F41A 9/65 |
| 2018/0180386 | A1 * | 6/2018 | Keller | F41G 1/04 |
| 2020/0132414 | A1 * | 4/2020 | Shelton | F41G 1/033 |

* cited by examiner

MAGAZINE RETENTION DEVICE WITH INTEGRATED AIMING SYSTEM

CROSS-REFERENCE TO RELATED APPLICATIONS

This patent application claims the benefit of U.S. Patent Application Ser. No. 62/794,705, filed Jan. 21, 2019, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of firearms. More specifically, the present disclosure relates generally to the field of firearm magazine holders and is particularly directed to a magazine retention device with integrated aiming system.

2. Description of Related Art

In certain situations, it is preferable or desired to have access to more than one firearm magazine, while shooting. Spare magazine pouches or carriers are known and are typically attached or coupled to belts, vests, plate carriers, or other articles of clothing that are worn by a user.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY AND OBJECTS OF THE DISCLOSURE

Unfortunately, there is no current design that allows a magazine retention device to be attached or coupled to a firearm or other device in a manner that provides a readily accessible firearm magazine and also provides a primary or backup aiming system for the firearm or other device.

These and other advantages of the present disclosure are attained by providing a magazine retention device with an integrated aiming system. The magazine retention device allows a spare magazine to be carried on the rail of a firearm for easier and faster access to reload the firearm. If the magazine retention device is positioned along the barrel of the firearm, providing a spare magazine within the magazine retention device provides extra weight on a location of the firearm that decreases muzzle rise and recoil.

In the case where the magazine retention device is mounted on the top rail in front of an optic or optical aiming device, if that device runs out of batteries or is otherwise disabled, the user will be able to use the integrated sights located on magazine retention device to aim the firearm (with or without a spare magazine being retained within the magazine retention device). This reduce the need to install backup sights and utilize that space to carry a spare magazine. This also reduces the need for the user to flip up the backup sights, saving time by just transitioning their eyes to the magazine retention device integrated sights.

The magazine retention device of the present disclosure overcomes the disadvantages of the conventional magazine retention device and achieves the above-mentioned objectives through the employment of magazine retention device, which are characterized by comprising a body portion, wherein the body portion extends, along a longitudinal axis, from a first end portion to a second end portion, wherein one or more interior wall portion(s) define an at least partial cavity of the body portion, wherein the cavity is formed so as to receive at least a portion of a magazine at least partially therein, wherein the magazine is at least partially securable within at least a portion of the cavity by frictional engagement between one or more exterior surfaces of the magazine and at least a portion of the one or more interior wall portion(s), and wherein a front sight is positioned proximate the first end portion and a rear sight is positioned proximate the second end portion; and an attachment portion, wherein the attachment portion extends from the body portion to allow the magazine retention device to be attached or coupled to a rail element, such that the longitudinal axis of the magazine retention device is substantially parallel to a longitudinal axis of the rail element.

In certain exemplary embodiments, the first end portion is an open first end portion and the second end portion is an open second end portion, and wherein the cavity extends from the first end portion to the second end portion.

In certain exemplary embodiments, the cavity comprises a bottom wall portion and wherein the cavity extends from an open first end portion to the bottom wall portion.

In certain exemplary embodiments, the interior wall portion(s) are formed to provide at least some frictional engagement between one or more exterior surfaces of the magazine and one or more portions of the interior wall portion(s), when the magazine is appropriately positioned within the cavity.

In certain exemplary embodiments, at least one projection extends from one or more of the interior wall portion(s), into at least a portion of the cavity.

In certain exemplary embodiments, the front sight and the rear sight are aligned along the longitudinal axis of the magazine retention device.

In certain exemplary embodiments, the front sight and the rear sight are formed as integral components of the magazine retention device and extend from the body portion.

In certain exemplary embodiments, the front sight and the rear sight extend from a top portion of the magazine retention device.

In certain exemplary embodiments, one or more installation grooves and/or installation recesses are formed in a portion of the body portion to allow for installation of the front sight and/or the rear sight.

In certain exemplary embodiments, the attachment portion extends from the body portion opposite a side from which the front sight and the rear sight extend.

In certain exemplary embodiments, the attachment portion extends along the longitudinal axis of the magazine retention device.

In certain exemplary embodiments, the attachment portion comprises opposing attachment arms. The attachment portion optionally comprises one or more pairs of opposing fastener apertures formed therethrough, wherein each opposing pair of fastener apertures is formed substantially perpendicular to the longitudinal axis, wherein fastener elements are positionable through the aligned fastener apertures, such that when the fastening elements are tightened, a distance between the attachment arms is decreased. In certain exemplary embodiments, a gap is provided in a portion of the body portion, between the attachment arms.

In certain exemplary embodiments, the attachment portion comprises a rail interface attachment.

In certain exemplary embodiments, the body portion and the attachment portion may optionally be formed as an integral unit alternatively, the body portion may optionally be attached or coupled to the attachment portion.

In certain exemplary embodiments, the magazine retention device further comprising a flexible magazine retention lever, wherein the magazine retention lever is defined by an open channel, which extends through a portion of the body portion, wherein the magazine retention lever includes an extension tab that extends from the magazine retention lever and is operable to interact with a magazine release recess of a magazine, wherein the magazine retention lever is movable between an engaged position wherein at least a portion of the extension tab extends into the cavity and a disengaged position wherein at least a portion of the extension tab is withdrawn from the cavity, and wherein the magazine retention lever is naturally biased to the engaged position.

In various exemplary, non-limiting embodiments, the present disclosure comprises a magazine retention device having a body portion, wherein the body portion extends, along a longitudinal axis, from a first end portion to a second end portion, wherein one or more interior wall portion(s) define a cavity of the body portion, wherein the first end portion is an open first end portion and the second end portion is an open second end portion, wherein the cavity extends from the first end portion to the second end portion and is formed so as to receive at least a portion of a magazine at least partially therein, wherein a flexible magazine retention lever is defined by an open channel, extending through a portion of the body portion, wherein the magazine retention lever includes an extension tab that extends from the magazine retention lever, wherein the magazine retention lever is movable between an engaged position wherein at least a portion of the extension tab extends into the cavity and a disengaged position wherein at least a portion of the extension tab is withdrawn from the cavity, wherein the magazine retention lever is naturally biased to the engaged position, and wherein a front sight is positioned proximate the first end portion and a rear sight is positioned proximate the second end portion; and an attachment portion, wherein the attachment portion extends from the body portion to allow the magazine retention device to be attached or coupled to a rail element, such that the longitudinal axis of the magazine retention device is substantially parallel to a longitudinal axis of the rail element.

In various exemplary, non-limiting embodiments, the present disclosure comprises a magazine retention device having a body portion that extends along a longitudinal axis of the body portion, wherein at least one cavity is defined within the body portion, wherein the at least one cavity is operable to receive at least a portion of a magazine at least partially therein, wherein a front sight extends from the body portion and a rear sight extends from the body portion, and wherein the front sight and the rear sight are aligned substantially parallel to the longitudinal axis of the magazine retention device; and an attachment portion that extends from the body portion to allow the magazine retention device to be attached or coupled to a rail element, such that the longitudinal axis of the magazine retention device is substantially parallel to a longitudinal axis of the rail element.

Accordingly, the presently disclosed systems, methods, and/or apparatuses separately and optionally provide improved magazine retention devices for firearms.

In various exemplary, nonlimiting embodiments, the present disclosure separately and optionally provides an improved magazine retention device that can be easily attached to a firearm.

In various exemplary, nonlimiting embodiments, the present disclosure separately and optionally provides an improved magazine retention device that provides primary or backup sights for a firearm.

In various exemplary, nonlimiting embodiments, the present disclosure separately and optionally provides an improved magazine retention device that provides a convenient and readily accessible spare magazine.

In various exemplary, nonlimiting embodiments, the present disclosure separately and optionally provides an improved magazine retention device that can be attached or coupled to a picatinny or other rail system.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the present disclosure discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

As detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale;

some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein:

FIG. 1 illustrates an upper, rear perspective view of an exemplary embodiment of a magazine retention device, according to the present disclosure;

FIG. 2 illustrates an upper, front perspective view of an exemplary embodiment of a magazine retention device, according to the present disclosure;

FIG. 3 illustrates a lower, rear perspective view of an exemplary embodiment of a magazine retention device, according to the present disclosure;

FIG. 4 illustrates a lower, front perspective view of an exemplary embodiment of a magazine retention device, according to the present disclosure;

FIG. 5 illustrates a right side view of an exemplary embodiment of a magazine retention device, according to the present disclosure;

FIG. 6 illustrates a left side view of an exemplary embodiment of a magazine retention device, according to the present disclosure;

FIG. 7 illustrates a top view of an exemplary embodiment of a magazine retention device, according to the present disclosure;

FIG. 8 illustrates a bottom view of an exemplary embodiment of a magazine retention device, according to the present disclosure;

FIG. 9 illustrates a front view of an exemplary embodiment of a magazine retention device, according to the present disclosure;

FIG. 10 illustrates a rear view of an exemplary embodiment of a magazine retention device, according to the present disclosure;

FIG. 11 illustrates a front, cross-sectional view taken along line 11-11 of the exemplary embodiment of a magazine retention device of FIG. 6, according to the present disclosure;

Figure 1:
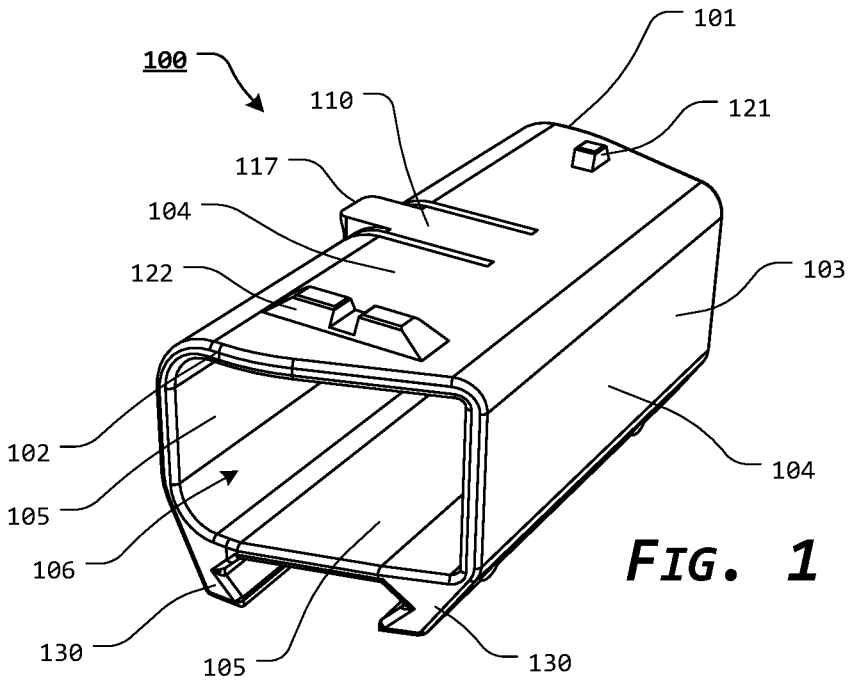
Figure 2:
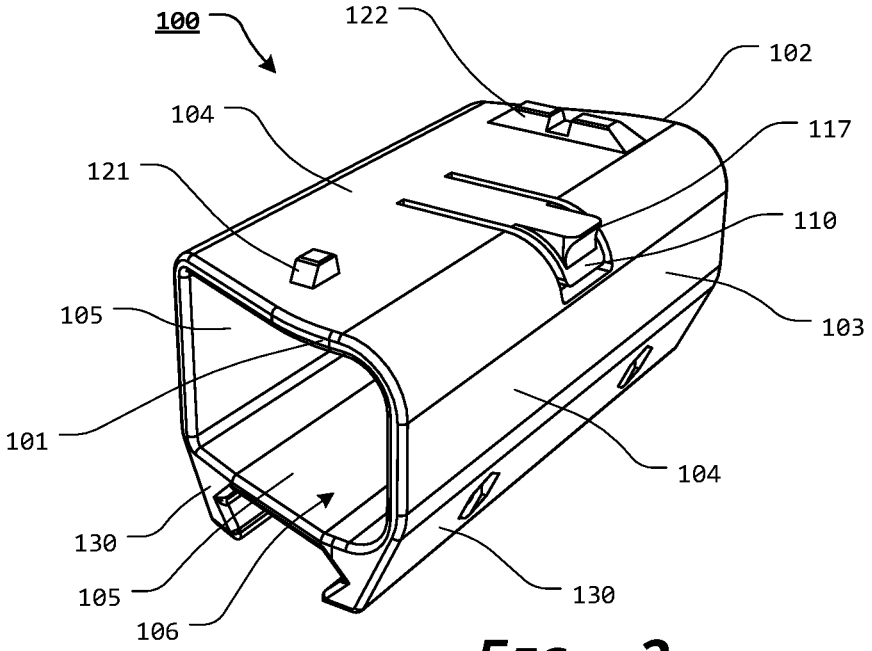
Figure 3:
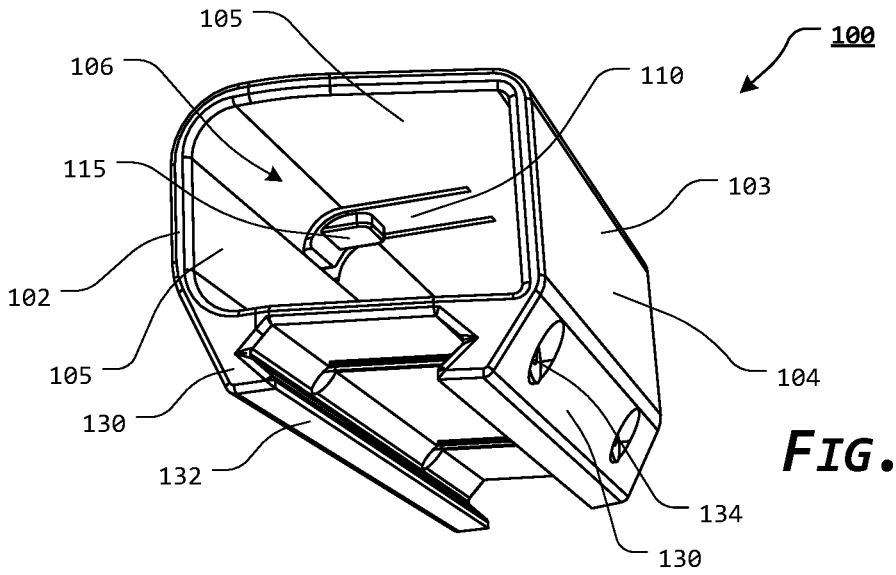
Figure 4:
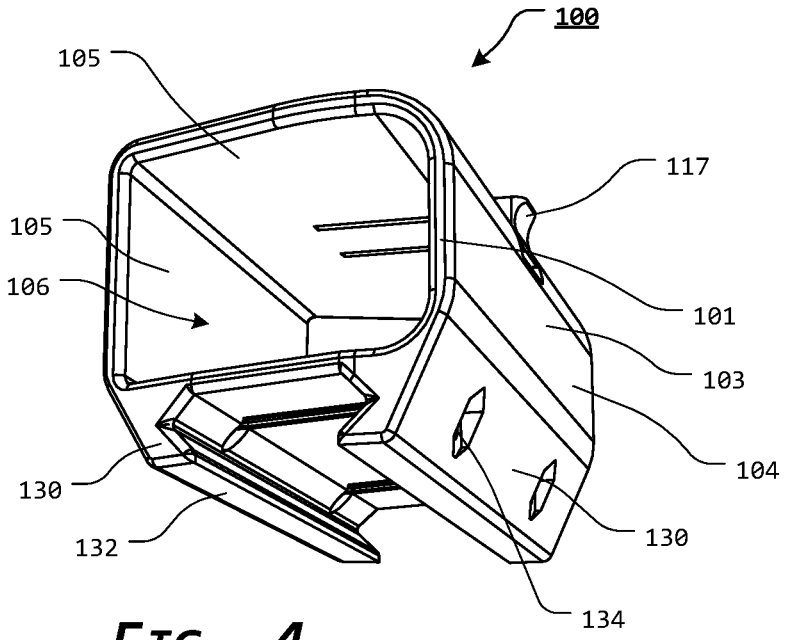
Figure 5:
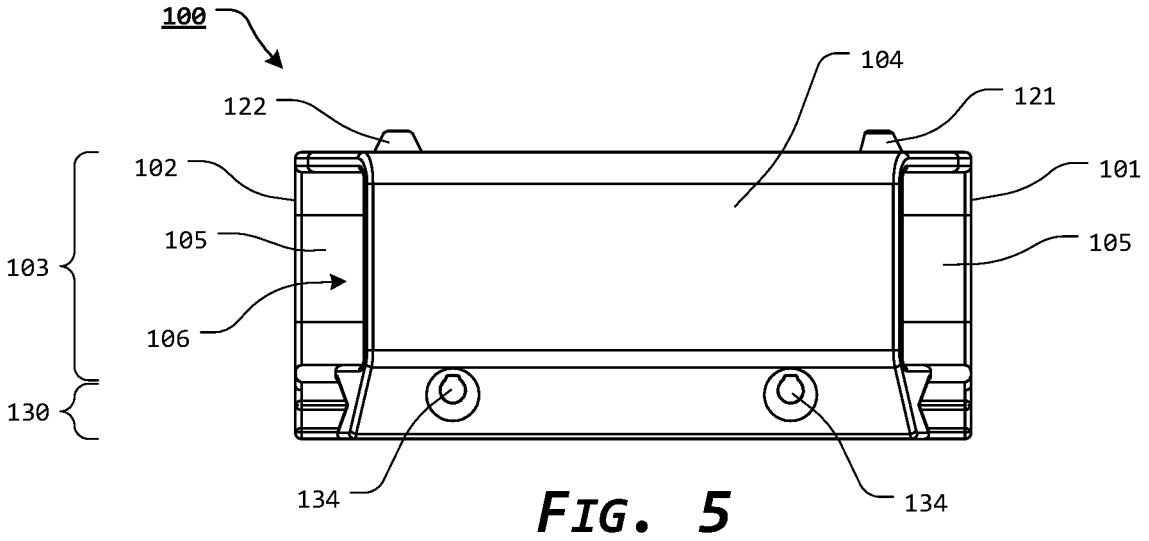
Figure 6:
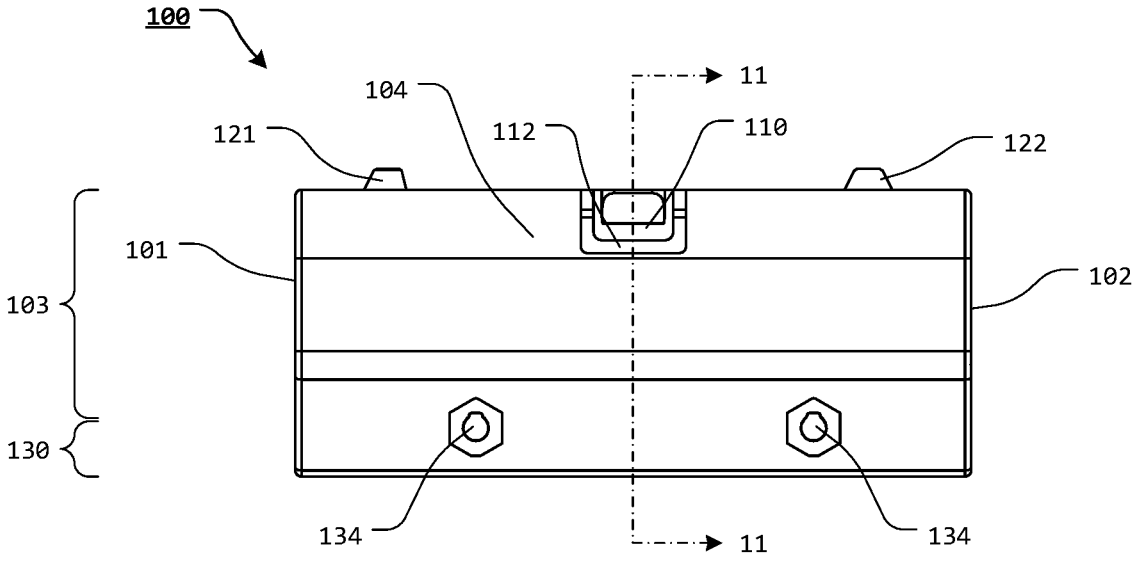
Figure 7:
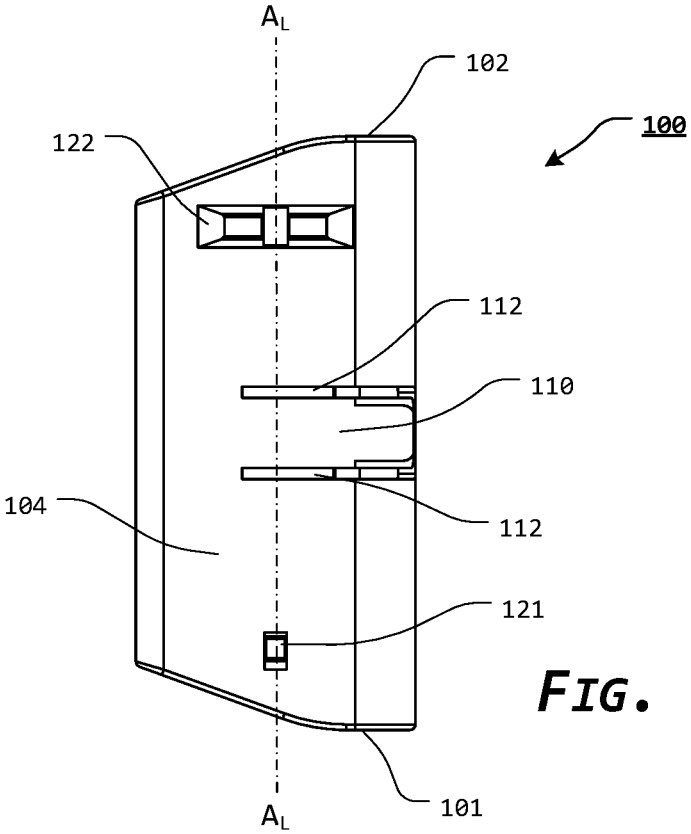
Figure 8:
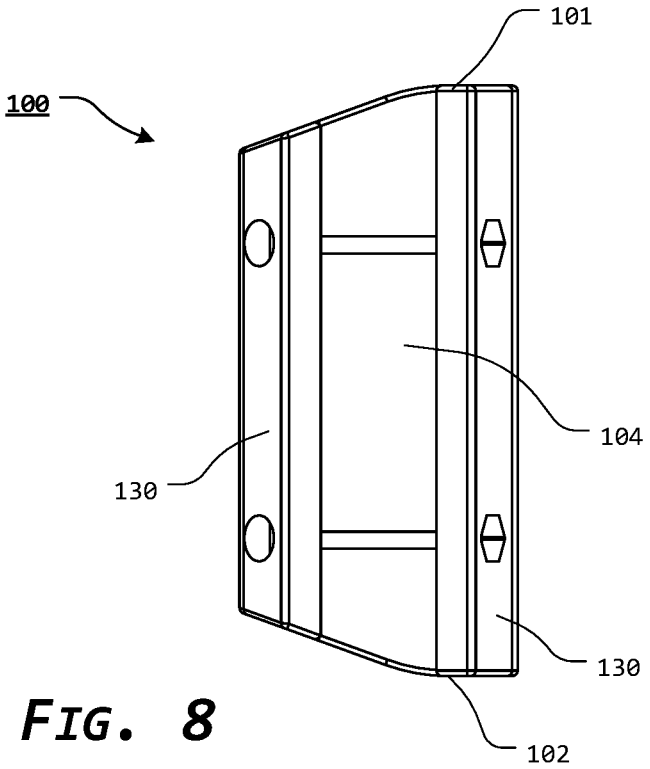
Figure 9:
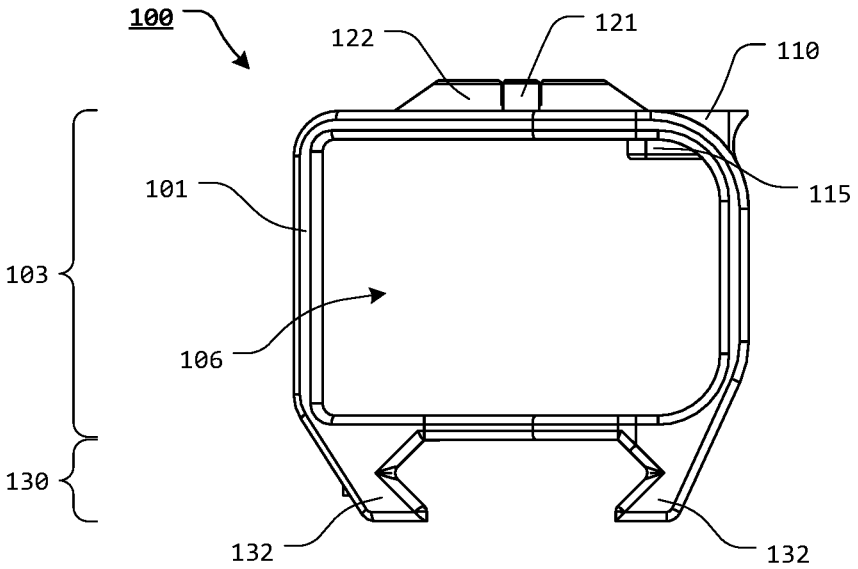
Figure 10:
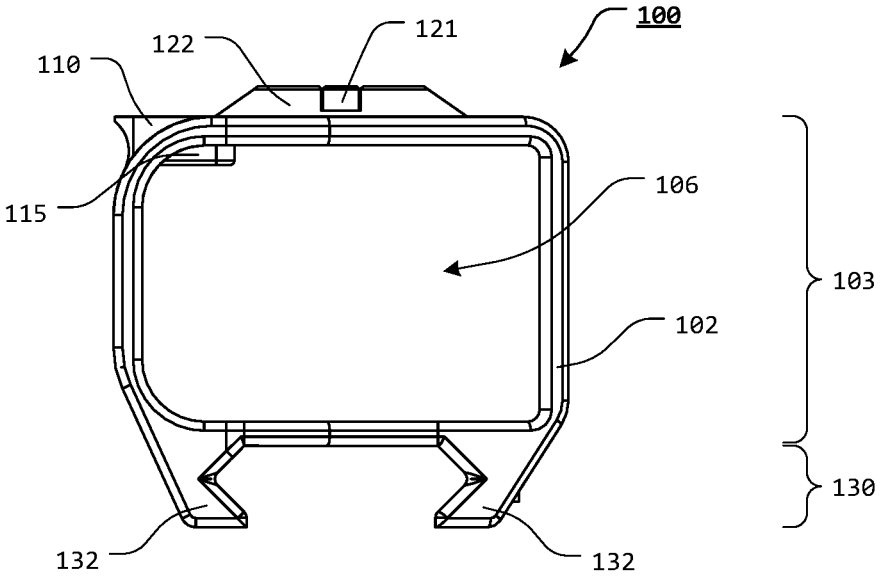
Figure 11:
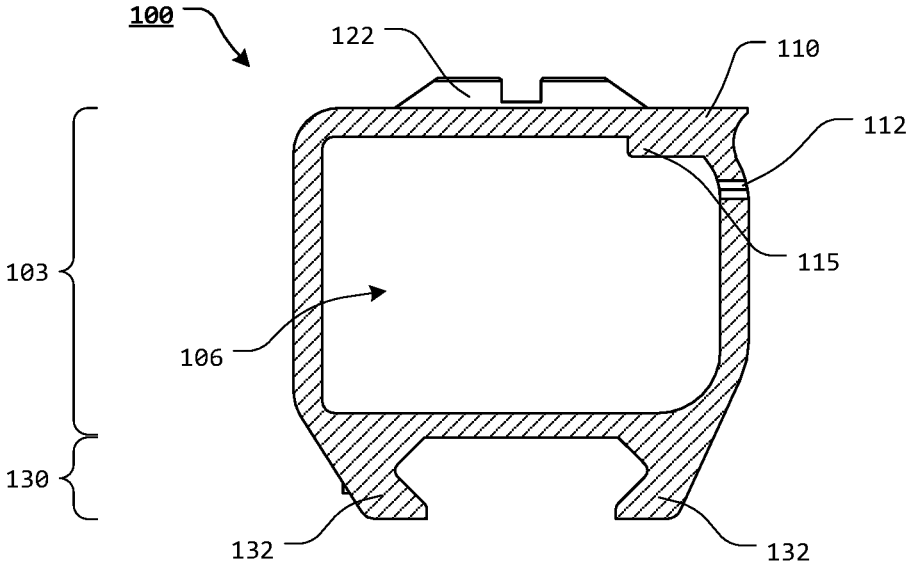
Figure 12:
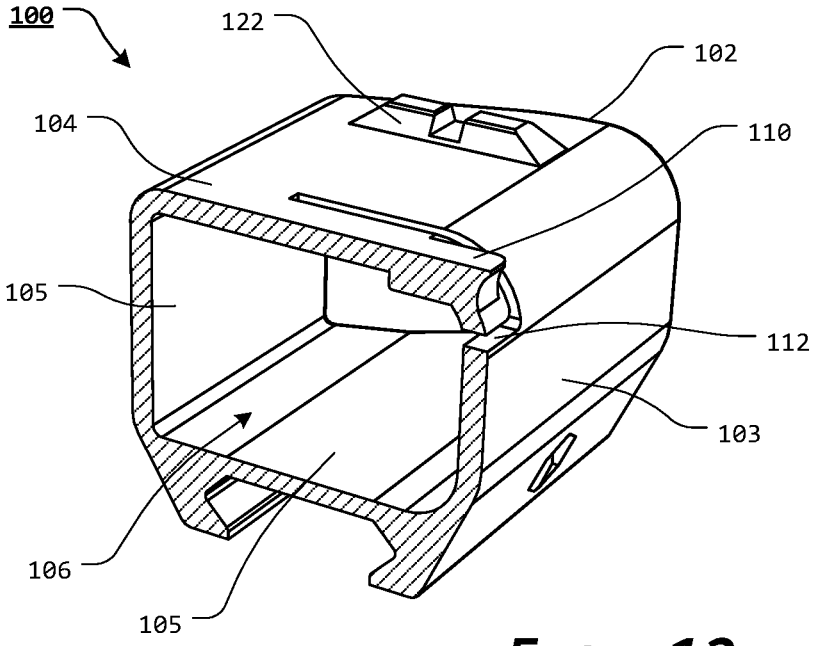
Figure 13:
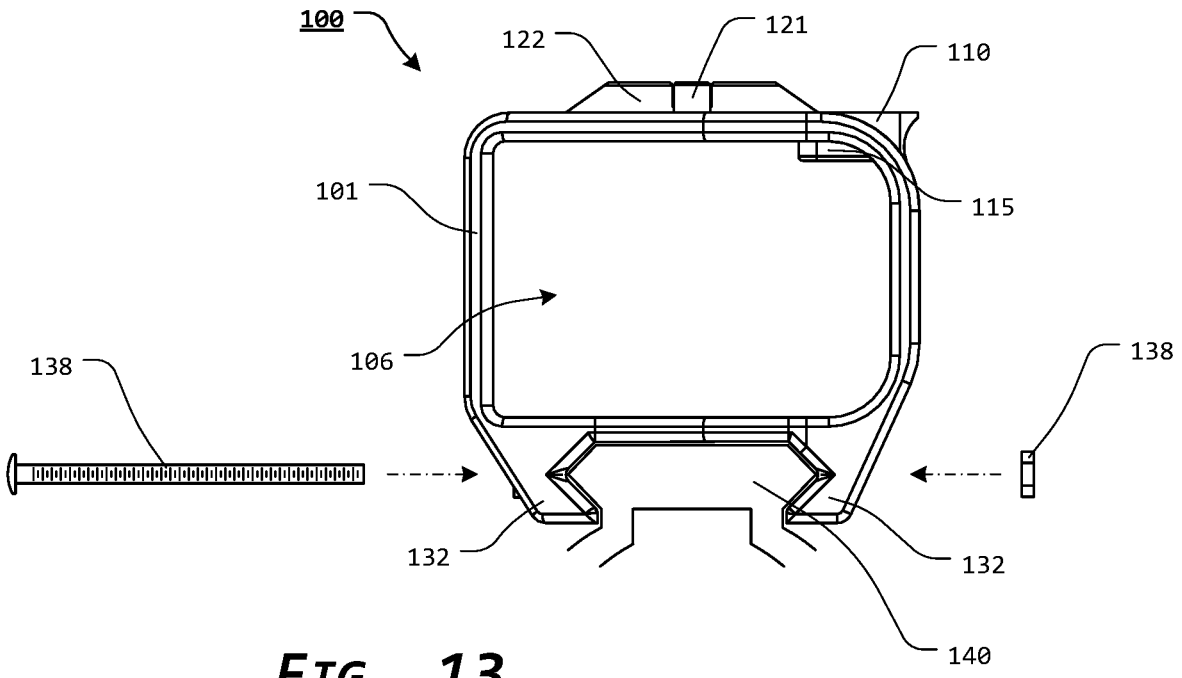
Figure 14:
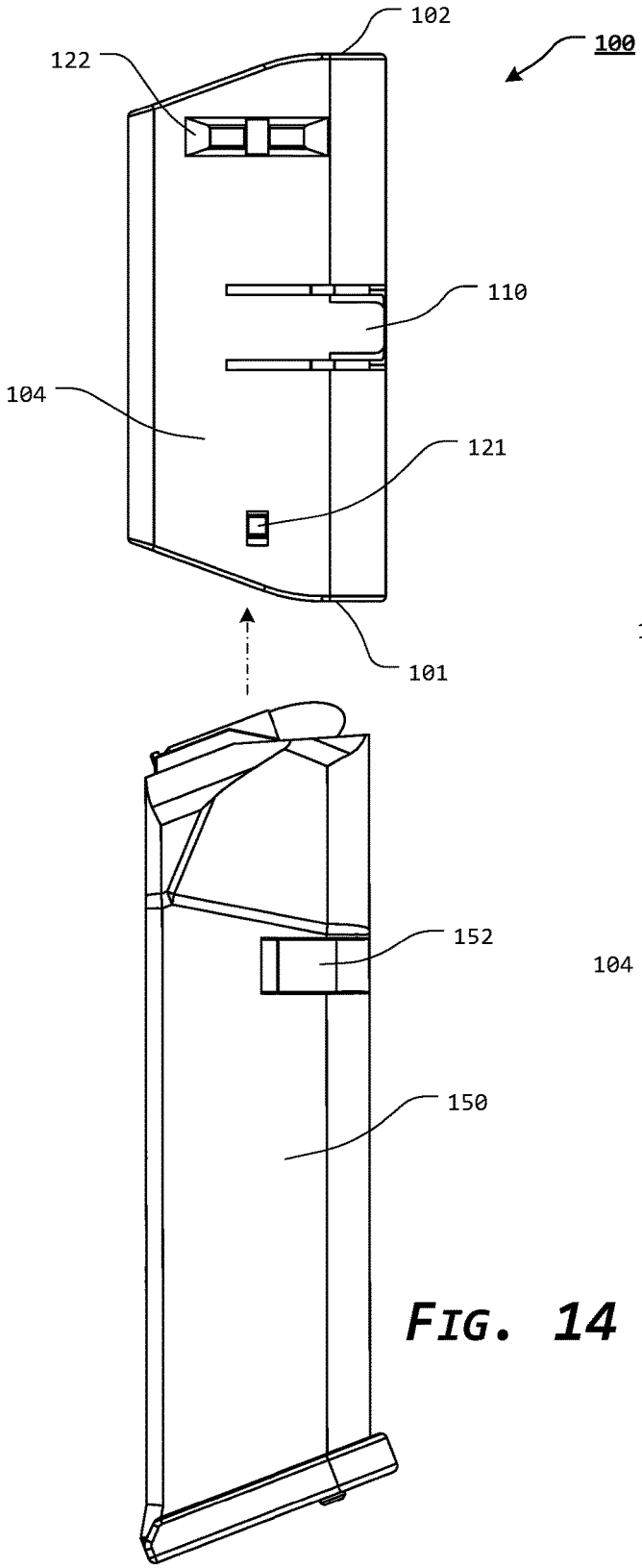
Figure 15:
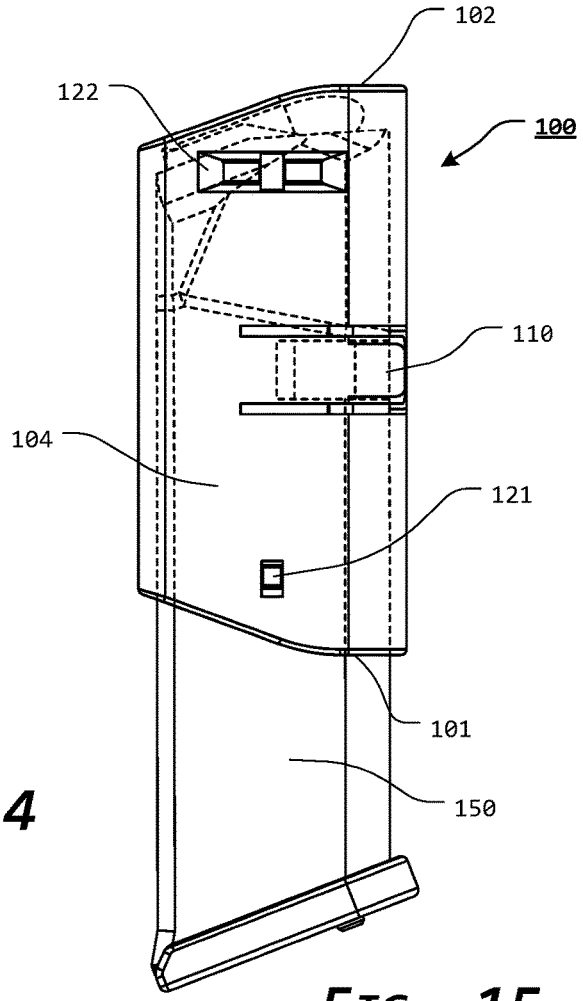
Figure 16:
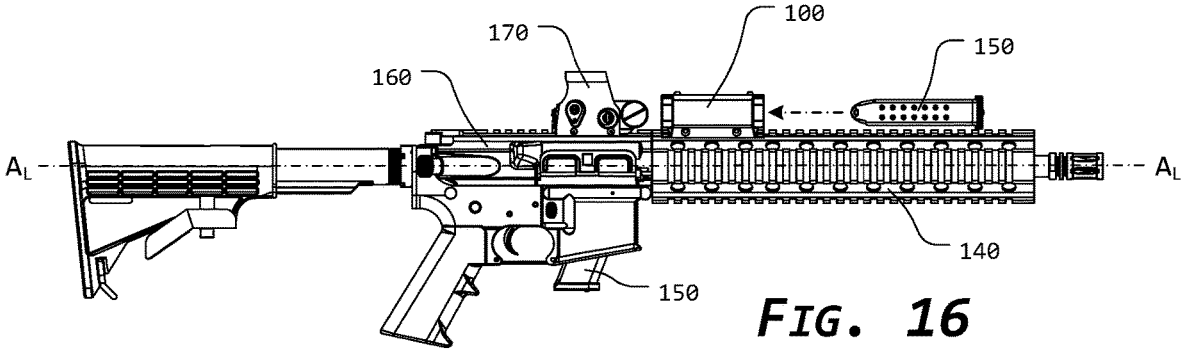
Figure 17:
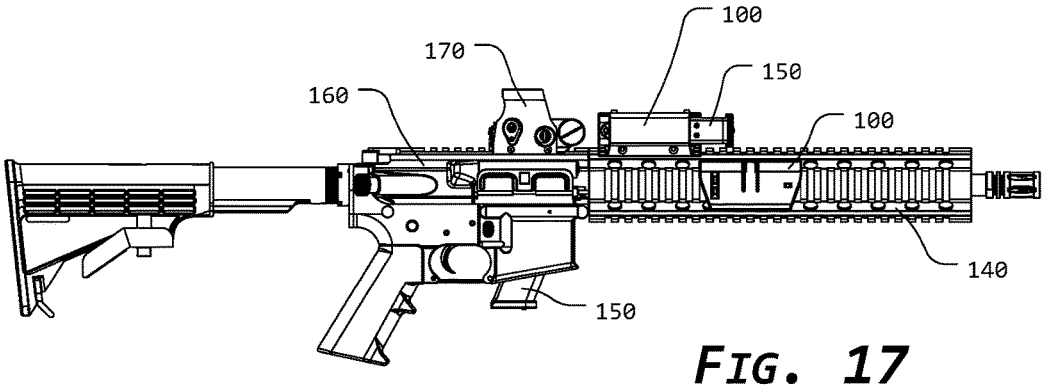
Figure 18:
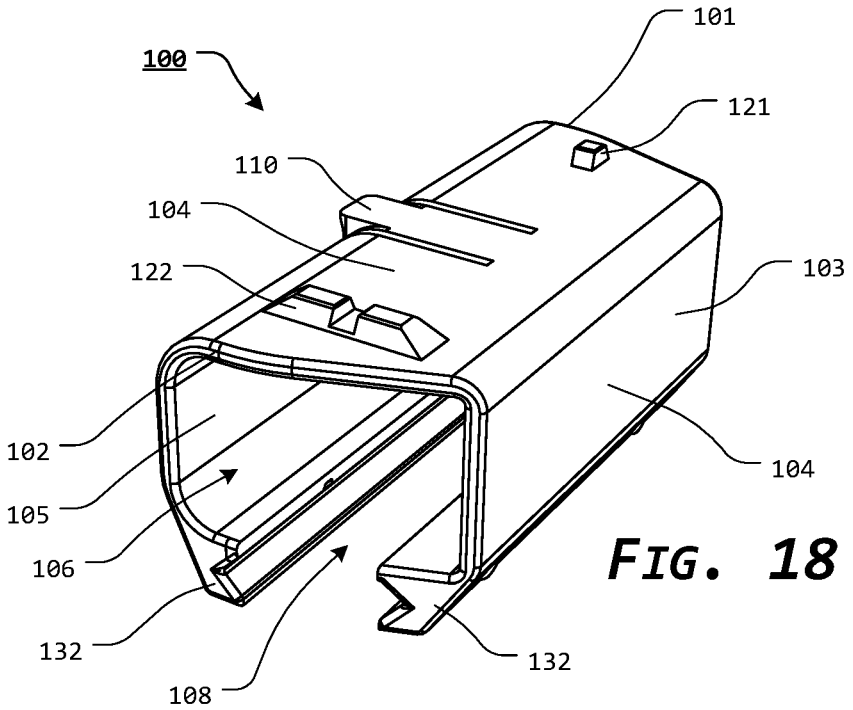
Figure 19:
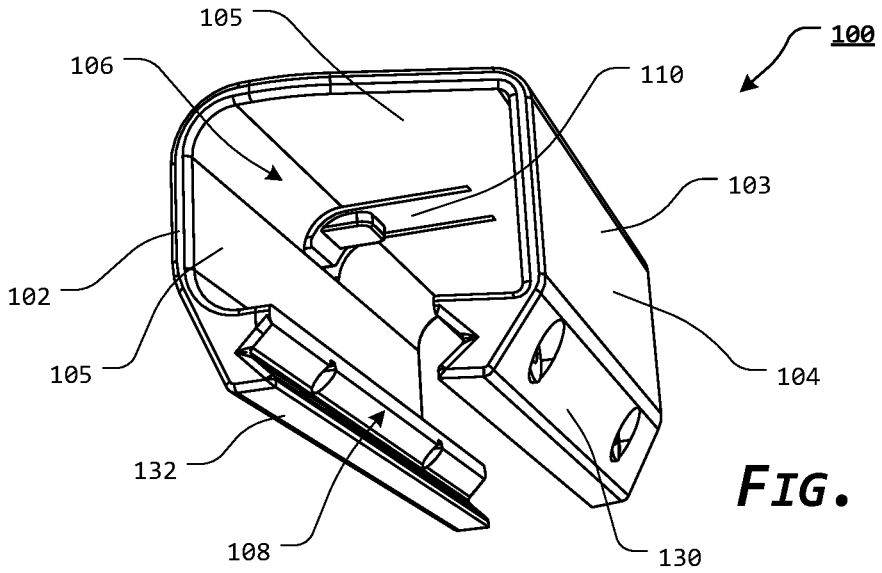
Figure 20:
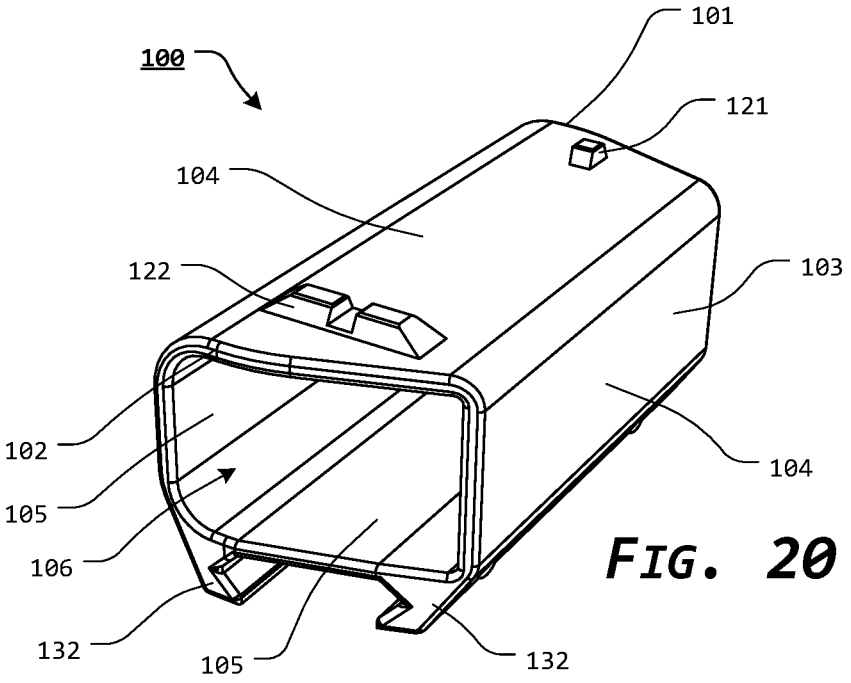
Figure 21:
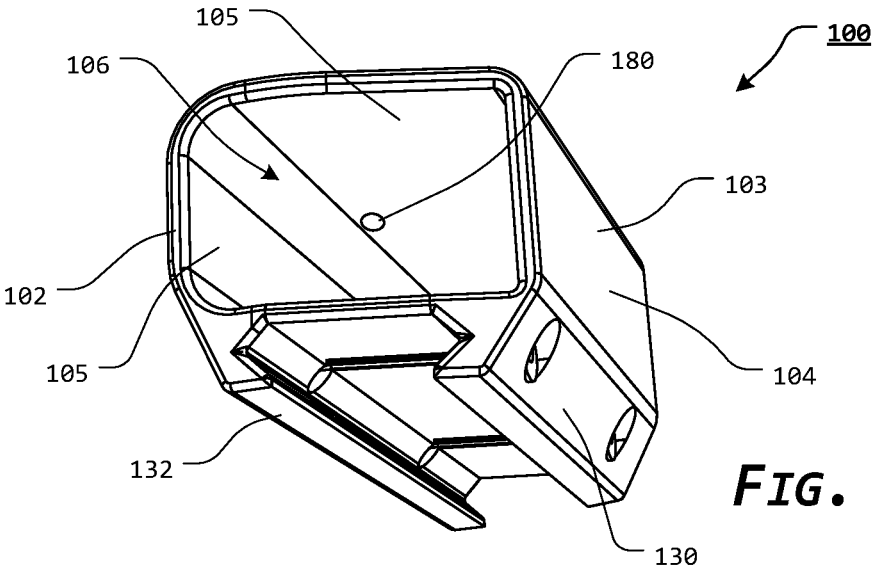
Figure 22:
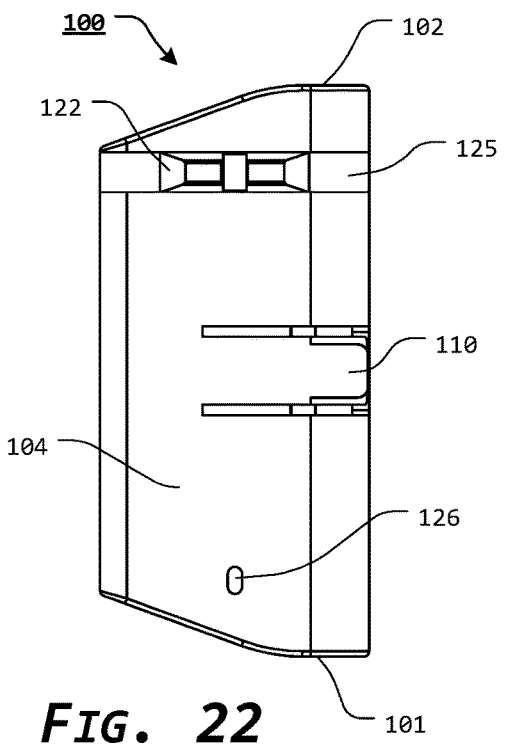
Figure 23:
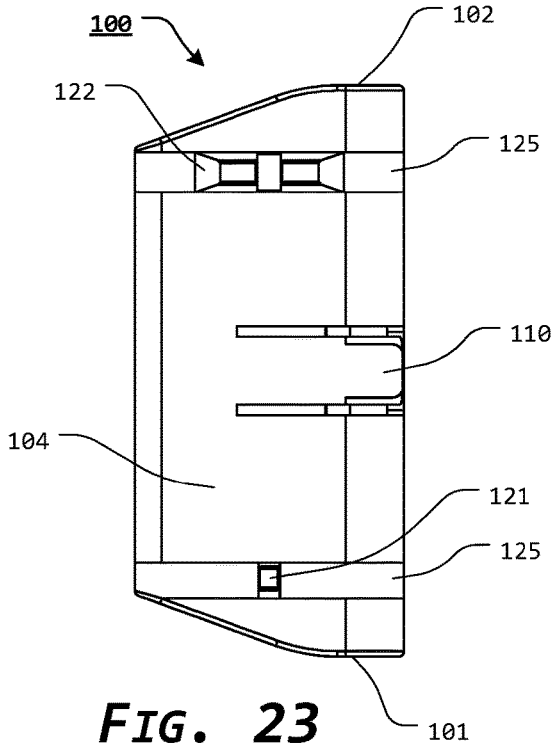
Figure 24:
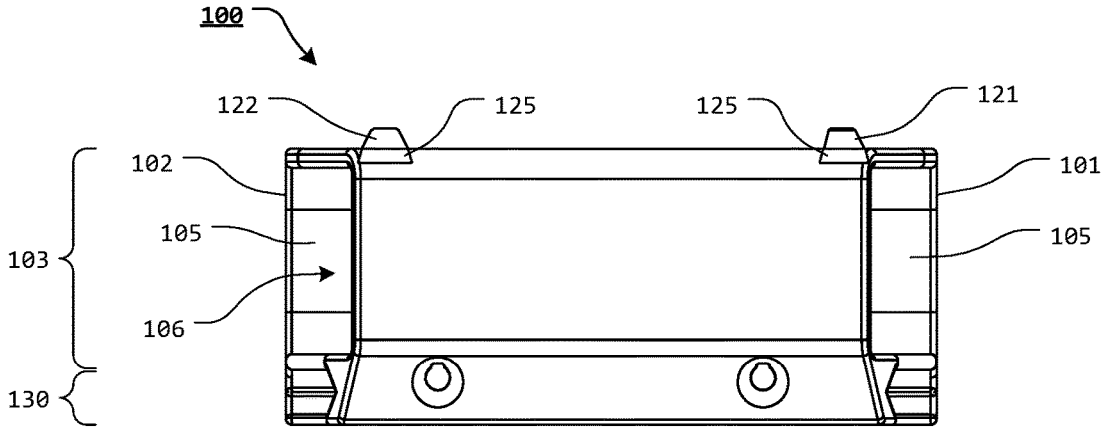
Figure 25:
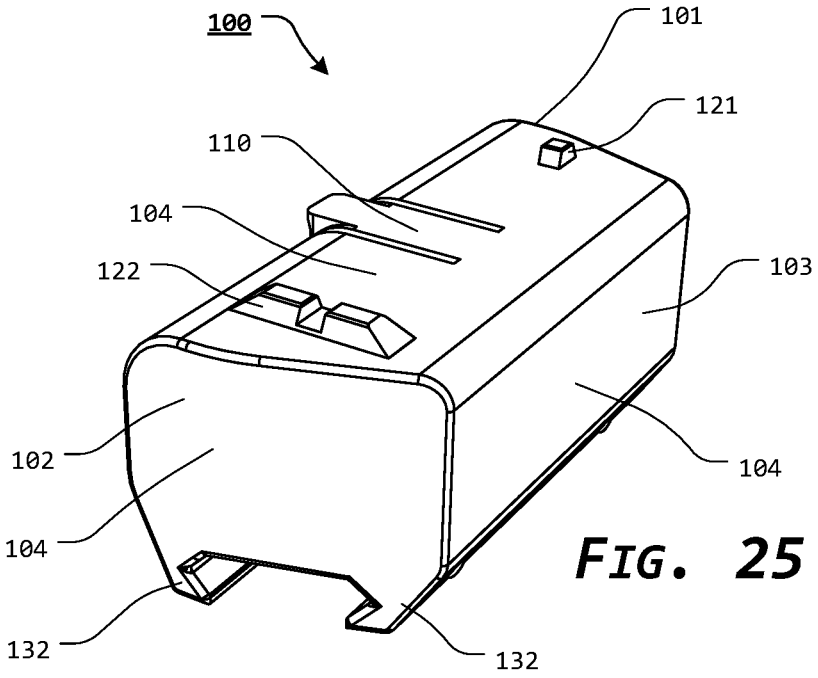
Figure 26:
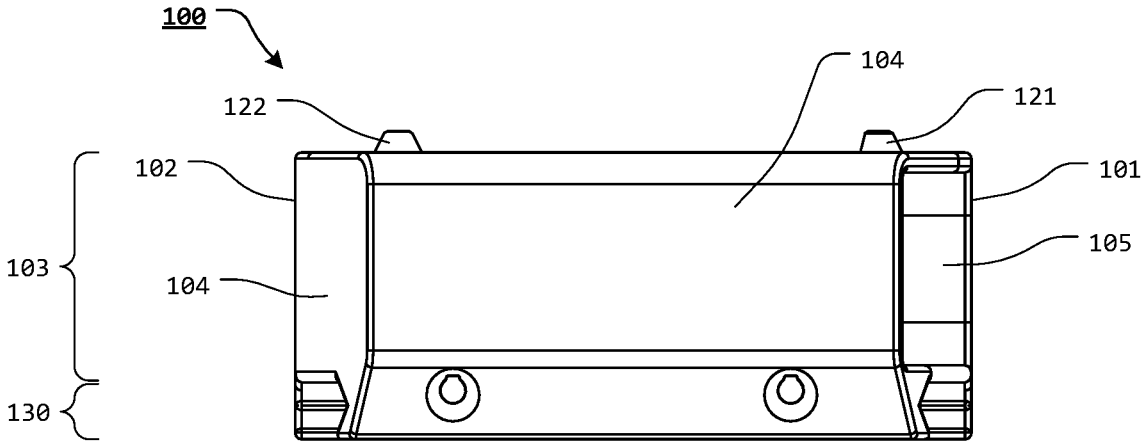
Figure 27:
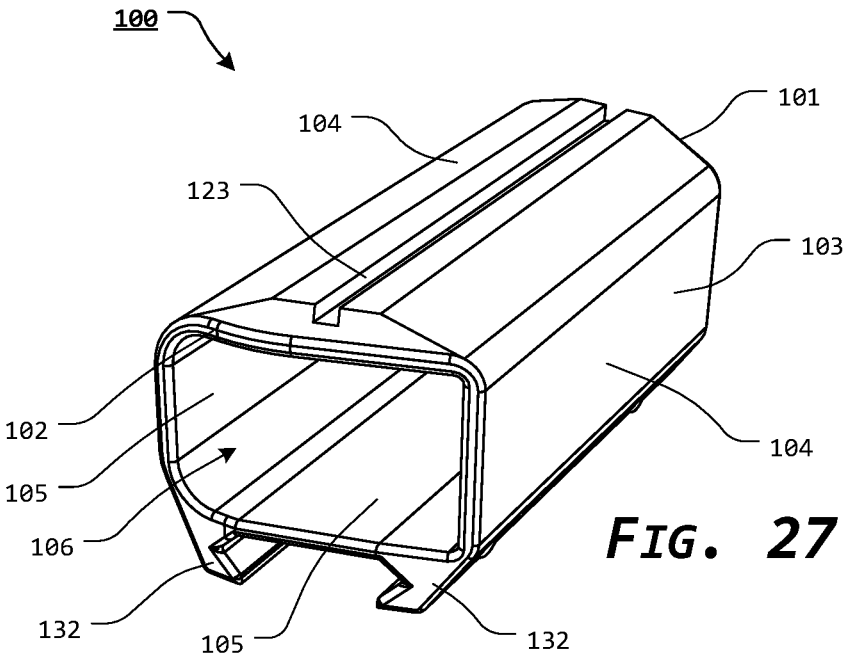
Figure 28:
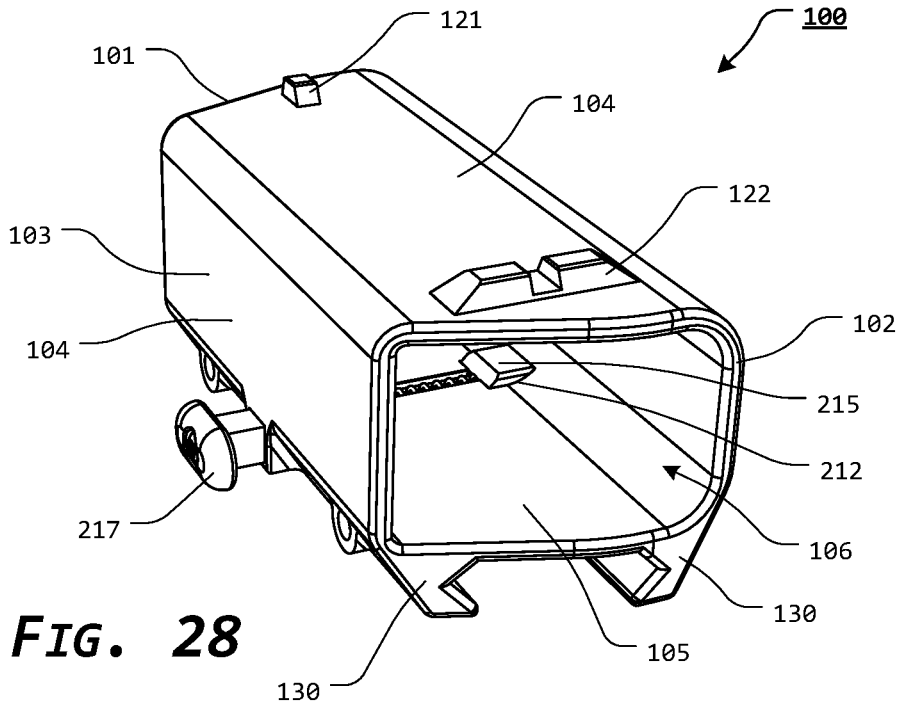
Figure 29:
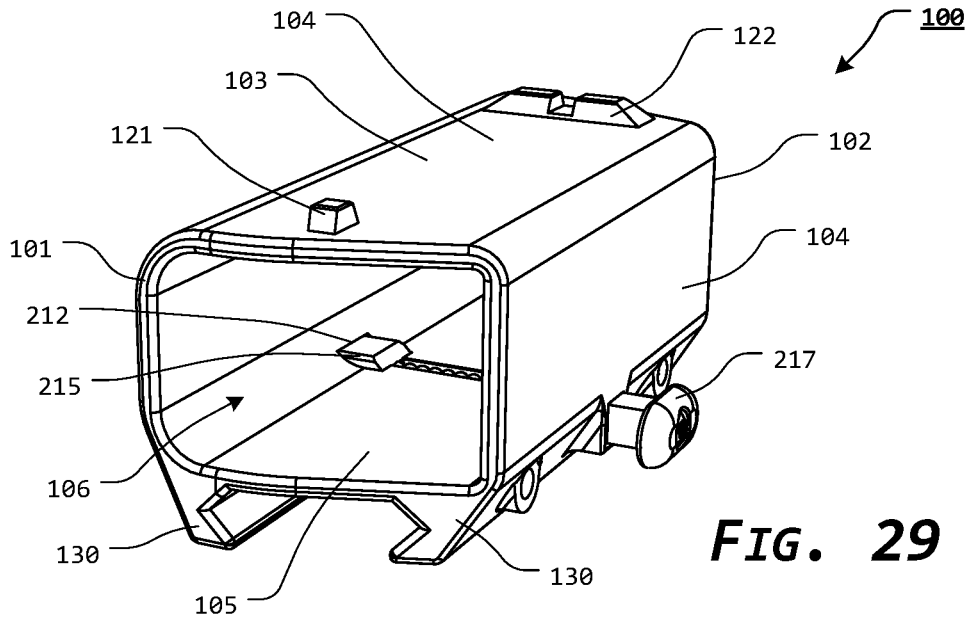
Figure 30:
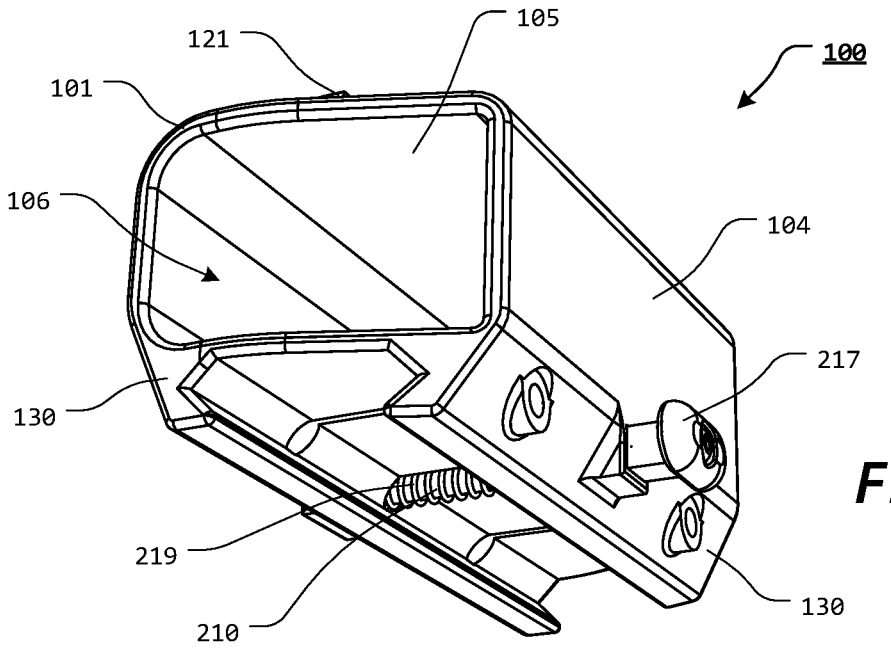
Figure 31:
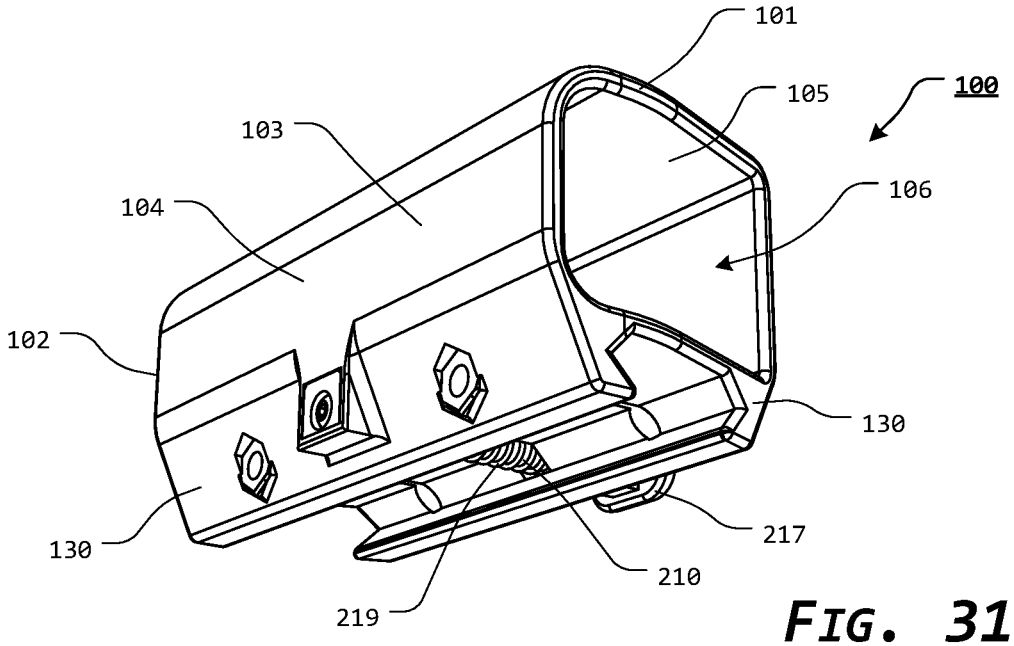
Figure 32:
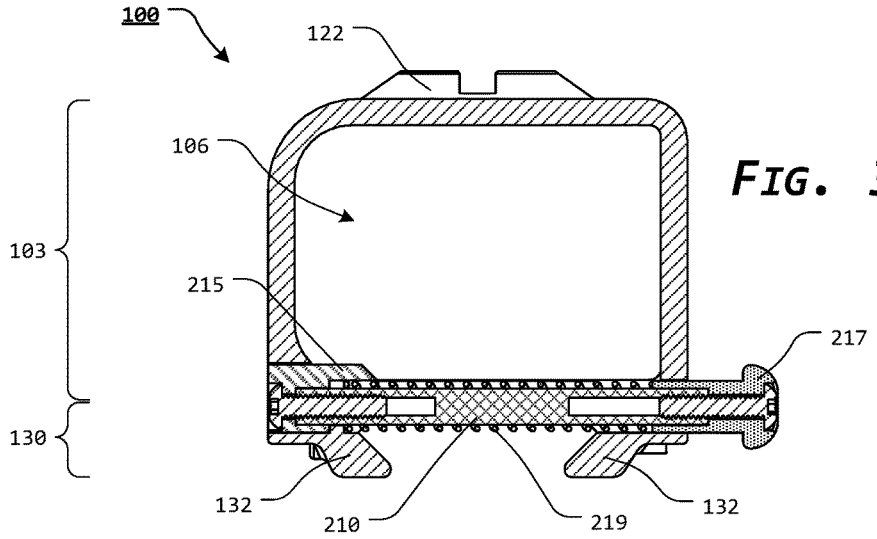
Figure 33:
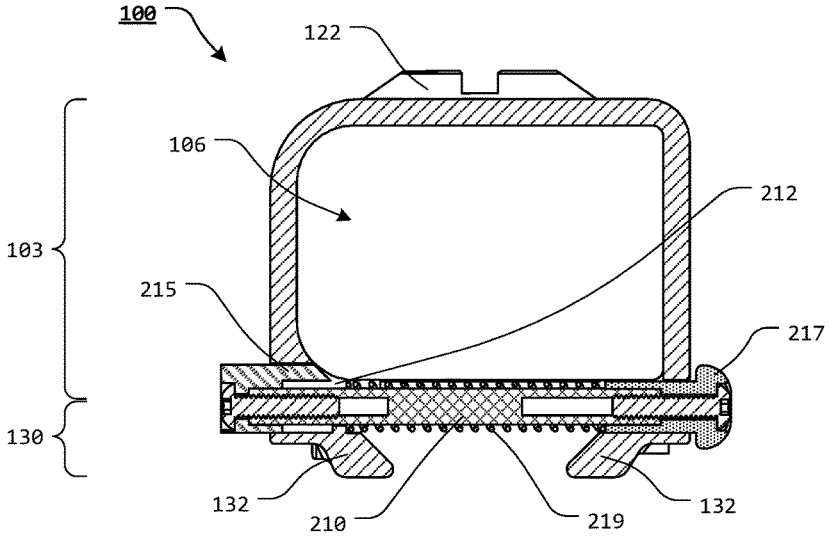
Figure 34:
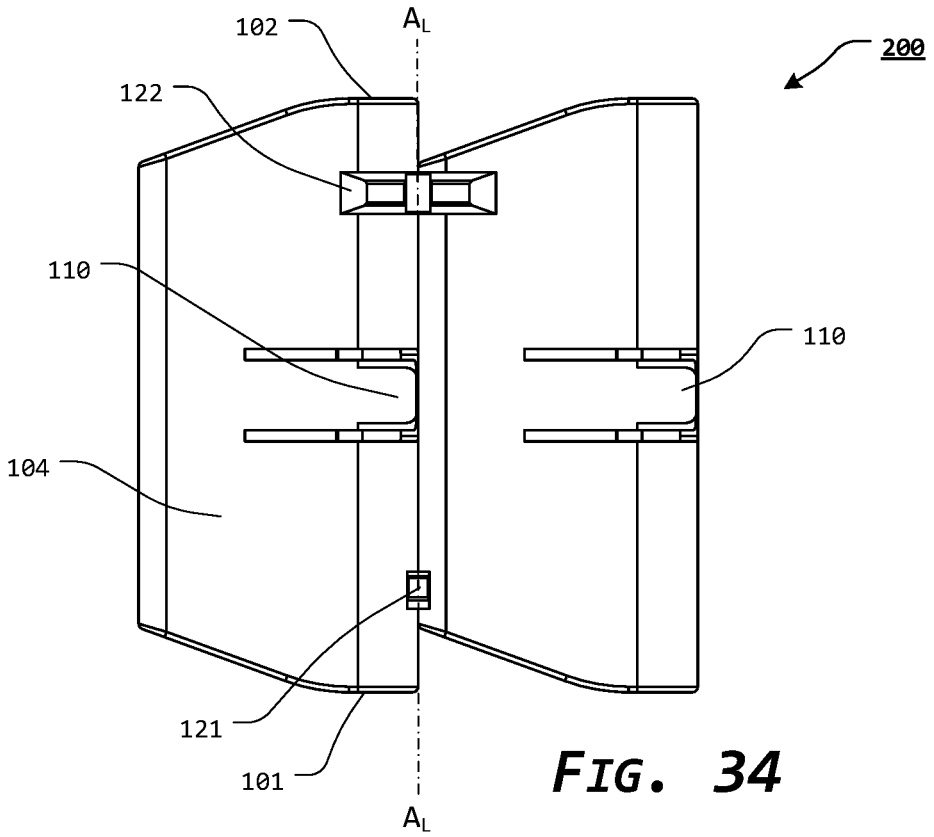
Figure 35:
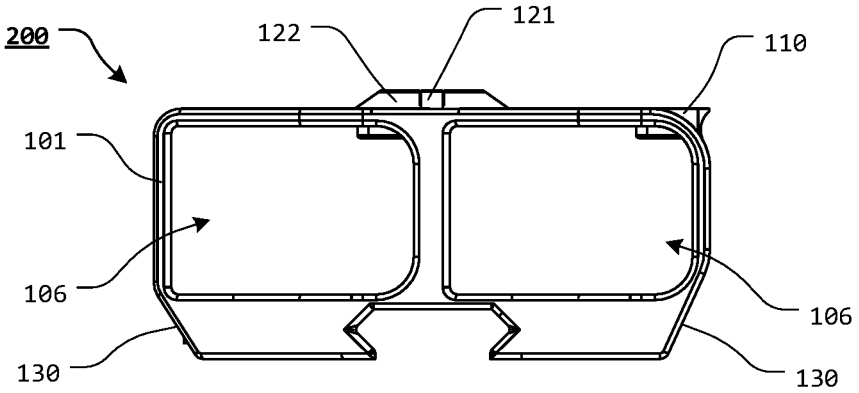
Figure 36:
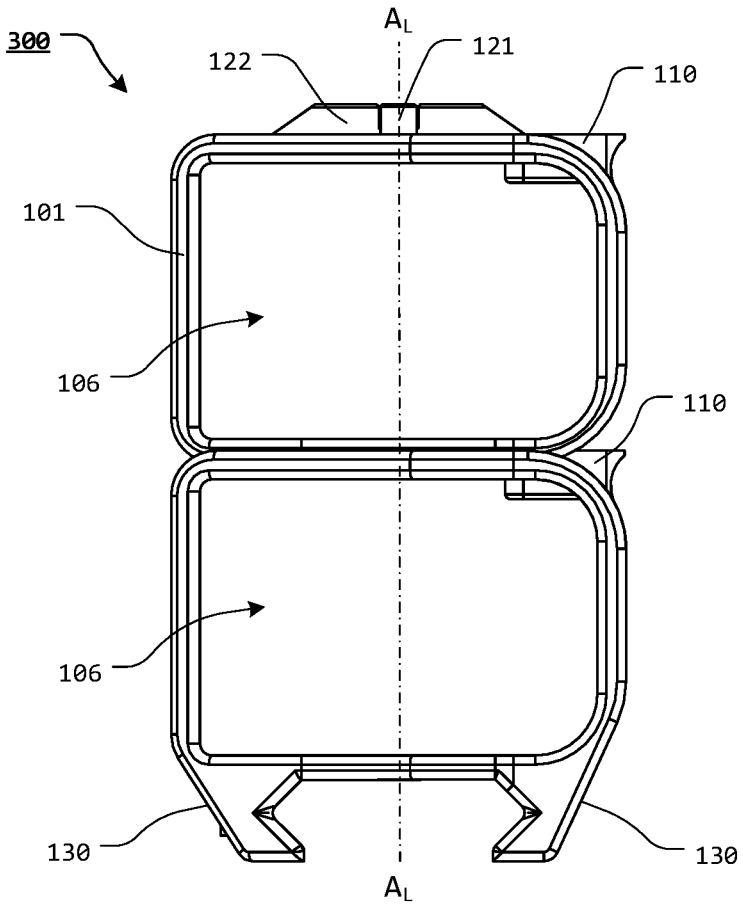

FIG. 12 illustrates an upper, front, perspective, cross-sectional view taken along line 11-11 of the exemplary embodiment of a magazine retention device of FIG. 6, according to the present disclosure;

FIG. 13 illustrates a front view of an exemplary embodiment of a magazine retention device being attached or coupled to a portion of a rail element, according to the present disclosure;

FIG. 14 illustrates a top view of an exemplary embodiment of an exemplary magazine positioned for insertion in an exemplary magazine retention device, according to the present disclosure;

FIG. 15 illustrates a top view of an exemplary embodiment of an exemplary magazine seated within an exemplary magazine retention device, according to the present disclosure;

FIG. 16 illustrates a right side view of an exemplary embodiment of a magazine retention device attached or coupled to an exemplary firearm, according to the present disclosure;

FIG. 17 illustrates a right side view of an exemplary embodiment of a magazine retention device attached or coupled to an exemplary firearm, according to the present disclosure;

FIG. 18 illustrates an upper, rear perspective view of an exemplary embodiment of a magazine retention device, according to the present disclosure;

FIG. 19 illustrates a lower, rear perspective view of an exemplary embodiment of a magazine retention device, according to the present disclosure;

FIG. 20 illustrates an upper, rear perspective view of an exemplary embodiment of a magazine retention device, according to the present disclosure;

FIG. 21 illustrates a lower, rear perspective view of an exemplary embodiment of a magazine retention device, according to the present disclosure;

FIG. 22 illustrates a top view of an exemplary embodiment of a magazine retention device, according to the present disclosure;

FIG. 23 illustrates a top view of an exemplary embodiment of a magazine retention device, according to the present disclosure;

FIG. 24 illustrates a right side view of an exemplary embodiment of a magazine retention device, according to the present disclosure;

FIG. 25 illustrates an upper, rear, perspective view of an exemplary embodiment of a magazine retention device, according to the present disclosure;

FIG. 26 illustrates a right side view of an exemplary embodiment of a magazine retention device, according to the present disclosure;

FIG. 27 illustrates an upper, rear, right perspective view of an exemplary embodiment of a magazine retention device, according to the present disclosure;

FIG. 28 illustrates an upper, rear, left perspective view of an exemplary embodiment of a magazine retention device, according to the present disclosure;

FIG. 29 illustrates an upper, front, left perspective view of an exemplary embodiment of a magazine retention device, according to the present disclosure;

FIG. 30 illustrates a lower, front, left perspective view of an exemplary embodiment of a magazine retention device, according to the present disclosure;

FIG. 31 illustrates a lower, front, right perspective view of an exemplary embodiment of a magazine retention device, according to the present disclosure;

FIG. 32 illustrates a front, cross-sectional view of an exemplary embodiment of a magazine retention device, illustrating the magazine retention lever in an engaged position, according to the present disclosure;

FIG. 33 illustrates a front, cross-sectional view of an exemplary embodiment of a magazine retention device, illustrating the magazine retention lever in a disengaged position, according to the present disclosure;

FIG. 34 illustrates a top view of an exemplary embodiment of a magazine retention device, according to the present disclosure;

FIG. 35 illustrates a front view of an exemplary embodiment of a magazine retention device, according to the present disclosure; and FIG. 36 illustrates a front view of an exemplary embodiment of a magazine retention device, according to the present disclosure.

DETAILED DESCRIPTION OF THE PRESENT DISCLOSURE

The foregoing and other objectives, features, and advantages of the invention will be more readily understood upon consideration of the following description of the invention taken in conjunction with the accompanying drawings.

For simplicity and clarification, the design factors and operating principles of the magazine retention device according to the present disclosure are explained with reference to various exemplary embodiments of magazine retention device according to the present disclosure. The basic explanation of the design factors and operating principles of the magazine retention device is applicable for the understanding, design, and operation of the magazine retention device of the present disclosure. It should be appreciated that the magazine retention device can be adapted to many applications where a magazine retention device is necessary or desirable.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "front" and "rear", "top" and "bottom", "upper" and "lower", and "horizontal" and "vertical" are used as a naming convention to arbitrarily distinguish between the exemplary embodiments and/or elements such terms describe. Thus, these terms are not necessarily intended to indicate temporal or other prioritization of such exemplary embodiments and/or elements, but are used to help differentiate between certain of the components of the present disclosure and are not to be construed as limiting the present disclosure.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "magazine retention device", "aiming system", "magazine", "rail element", and "firearm" are used for basic explanation and understanding of the operation of the systems, methods, and apparatuses of the present disclosure. Therefore, the terms "magazine retention device", "aiming system", "magazine", "rail element", and "firearm" are not to be construed as limiting the systems, methods, and apparatuses of the present disclosure.

For simplicity and clarification, the magazine retention device of the present disclosure will be described as being used as a magazine retention device for a semiautomatic-type pistol magazine, such as, for example, semiautomatic-type pistol magazine 150. However, it should be appreciated that these are merely exemplary embodiments of the magazine retention device and are not to be construed as limiting the present disclosure. Thus, the magazine retention device of the present disclosure may be utilized in connection with any type of handgun, rifle, shotgun, or other desired magazine or ammunition carrying device.

Turning now to the appended drawing figures, FIGS. 1-33 illustrate certain elements and/or aspects of a magazine retention device 100, FIGS. 34-35 illustrate certain elements and/or aspects of a magazine retention device 200, and FIG. 36 illustrates certain elements and/or aspects of a magazine retention device 300 according to the present disclosure.

In illustrative, non-limiting embodiment(s) of the presently disclosed systems, methods, and/or apparatuses, as illustrated in FIGS. 1-33, the exemplary magazine retention device 100 comprises a magazine retention device body portion 103 and a magazine device attachment portion 130. The magazine device body portion 103 extends, along a longitudinal axis, $A_L$, from a first end portion 101 to a second end portion 102.

One or more exterior wall portion(s) 104 define the exterior of the magazine retention device body portion 103. One or more interior wall portion(s) 105 define an at least partial cavity 106 of the magazine retention device body portion 103.

The cavity 106 is formed so as to receive and hold at least a portion of a magazine 150 at least partially therein. In various exemplary embodiments, as illustrated in FIGS. 1-24, the cavity 106 is defined by one or more interior wall portion(s) 105 and extends from the first end portion 101 to the second end portion 102, providing an open first end portion 101 and an open second end portion 102. Alternatively, as illustrated in FIGS. 25-26, the cavity 106 is defined by one or more interior wall portion(s) 105 and a bottom wall portion (shown as the exterior wall portion 104 extending to cover the second end portion 102).

The at least partial cavity 106 may be formed from any number or combination of sidewalls, side, front, and/or rear walls, or interior wall portion(s) 105, including, for example, a single, continuous wall portion 105 or multiple coupled or joined interior wall portion(s) 105. Thus, the at least partial cavity 106 may define a cavity, a partial cavity, or a space that is capable of retaining a portion of a magazine 150.

In certain exemplary embodiments, the interior wall portion(s) 105 of the magazine retention device body portion 103 may generally be planar. Alternatively, the interior wall portion(s) 105 of the magazine retention device body portion 103 may be contoured or shaped to generally follow the contours of at least a portion of the outer surface of the magazine 150 to better accommodate a specific type or model of magazine 150 to be retained within the magazine retention device 100.

The interior wall portion(s) 105 may be formed to be able to maintain the magazine 150 within the cavity 106 by frictional engagement between one or more exterior surfaces of the magazine 150 and one or more portions of the interior wall portion(s) 105, when the magazine 150 is appropriately positioned within the cavity 106.

As illustrated in FIGS. 1-19 and 22-26, the magazine retention device 100 may optionally include a magazine retention lever 110 to further engage at least a portion of the magazine 150 to maintain the magazine 150 within the cavity 106. As illustrated, the magazine retention lever 110 is defined by an open channel 112, which extends through the exterior wall portion(s) 104 and the interior wall portion (s) 105. In various exemplary embodiments, the open channel 112 is a substantially "U" shaped channel.

The open channel 112 is formed so as to allow the magazine retention lever 110 to flex and allow at least a portion of the magazine retention lever 110 to be pressed or urged from a naturally biased, engaged position to a disengaged position. A finger engagement portion 117 may be formed to extend from the magazine retention lever 110 to provide better purchase of a user's finger on the magazine retention lever 110, to aid in manipulating the magazine retention lever 110 from the engaged position to the disengaged position.

An extension tab 115 extends from the interior wall portion 105 of the magazine retention lever 110. In the naturally biased, engaged position, at least a portion of the extension tab extends into the cavity 106. When the magazine retention lever 110 is urged to the disengaged position, the extension tab 115 is at least partially withdrawn or fully withdrawn from the cavity 106. When the magazine retention lever 110 is released, the natural bias of the magazine retention lever 110 urges the magazine retention lever 110 to return to its original, engaged position.

In various exemplary embodiments, the extension tab 115 includes a ramp surface that extends outward from the magazine retention lever 110 to a shoulder. The shoulder then returns to the surface of the magazine retention lever 110. In various exemplary embodiments, the shoulder includes a planar surface that extends approximately 90° relative to a planar surface formed by the magazine retention lever 110.

In various exemplary embodiments, an edge or transition between a terminal surface of the extension tab 115 and side surfaces of the extension tab 115 may be radiused or ramped. By providing a perpendicular (90°) edge or transition between a terminal surface of the extension tab 115 and a side surface of the extension tab 115, a portion of the extension tab 115 more positively engage the edge surfaces of the magazine release recess 152 of an inserted magazine 150. If an edge or transition between a terminal surface of the extension tab 115 and side surfaces of the extension tab 115 is at least partially radiused or ramped, contact between an edge surface of the magazine release recess 152 and an edge or transition of the extension tab 115 may allow the extension tab 115 to more easily slide along a terminal surface of the extension tab 115 and potentially urge the magazine retention lever 110 from the engaged position to the disengaged position, provided a sufficient amount of insertion force or removal force is applied to the magazine 150. Thus, by altering an edge or transition between a terminal surface of the extension tab 115 and side surfaces of the extension tab 115, the amount of insertion force or removal force required to transition the magazine retention lever 110 from the engaged position to the disengaged position may be altered, as desired.

As illustrated in FIGS. 14 and 15, during initial use of the magazine retention device 100, the magazine retention device 100 is initially presented in an empty condition with the magazine retention lever 110 biased to the engaged position. To insert and retain a magazine 150 within the cavity 106 of the magazine retention device 100, the magazine 150 is initially aligned with the cavity 106, with the top end of the magazine 150 facing the first end portion 101. Then, the top end of the magazine 150 is inserted within the open first end portion 101 of the cavity 106. As the magazine 150 is initially seated within the cavity 106, the magazine 150 is guided into position by at least some of the interior wall portion(s) 105.

As the magazine 150 is inserted further into the cavity 106, an outer surface of the magazine 150 contacts the terminal end of the extension tab 115. As the magazine 150 is positioned in the cavity 106, contact between the outer surface of the magazine 150 and the terminal end of the extension tab 115 displaces the extension tab 115 from the cavity 106 (via flex of the magazine retention lever 110) a sufficient amount such that the magazine 150 can be fully inserted into the cavity 106. When appropriately inserted, the magazine retention lever 110 continues to be flexed towards the disengaged position, the terminal end of the extension tab 115 rides along a contact portion of the magazine 150 until the extension tab 115 passes a point of contact with the outer surface of the magazine 150 and the extension tab 115 engages the magazine release recess 152 of the magazine 150.

When the extension tab 115 engages the magazine release recess 152, the bias of the magazine retention lever 110 causes the magazine retention lever 110 to return to the engaged position and at least a portion of the extension tab 115 is maintained within the magazine release recess 152, thereby maintaining the magazine retention lever 110 in the engaged position.

Thus, the magazine 150 is secured in the cavity 106 of the magazine retention device 100 by engagement between exterior surfaces of the magazine 150 and interior wall portion(s) 105 and further by operation of the extension tab 115 maintaining the extension tab 115 in the engaged position, thereby blocking removal of the magazine 150. While the magazine 150 is fully seated in the cavity 106, with the magazine retention lever 110 maintained in the engaged position, removal of the magazine 150 is not permitted.

In various exemplary embodiments, as a magazine 150 is inserted into the cavity 106, a ramped surface or feature of the magazine 150 may initially engage the extension tab 115 and, as the magazine 150 continues to be inserted within the cavity 106, urge the extension tab 115 to the disengaged position, without manipulation of the finger engagement portion 117 or the magazine retention lever 110, by the user. Once the magazine 150 is appropriately positioned within the cavity 106, the extension tab 115 engages a magazine release recess 152. When the extension tab 115 engages the magazine release recess 152, the bias of the magazine retention lever 110 causes the magazine retention lever 110 to return to the engaged position and at least a portion of the extension tab 115 is maintained within the magazine release recess 152, thereby maintaining the magazine retention lever 110 in the engaged position.

In order to release the magazine 150, the user urges the magazine retention lever 110 toward the disengaged position. As the magazine retention lever 110 is urged toward the disengaged position, the extension tab 115 is removed from the magazine release recess 152. When the extension tab 115 is sufficiently removed from the magazine release recess 152, the magazine 150 can be withdrawn from the cavity 106.

When the magazine 150 is sufficiently withdrawn from the cavity 106 and the extension tab 115 clears or disengages the magazine 150, the bias of the magazine retention lever 110 returns the magazine retention lever 110 to the engaged position.

In certain exemplary embodiments, the degree of flex of the magazine retention lever 110 may be such that the amount of force necessary to urge the magazine retention lever 110 toward the disengaged position is reduced. In these embodiments, a user may merely grasps the magazine 150 and apply a sufficient removal force to the magazine 150 to urge the magazine retention lever 110 to the disengaged position and the extension tab 115 from the magazine release recess 152. Thus, manipulation of the magazine retention lever 110 is not required to remove the magazine 150 from the cavity 106.

In still other embodiments, as illustrated in FIGS. 20 and 21, the magazine retention lever 120 is not included, but an optional projection 180 extends from one or more of the interior wall portion(s) 105. The optional projection 180 they be positioned so as to be positioned within the magazine release recess 152, when the magazine 150 is appropriately positioned within the cavity 106. Thus, the magazine 150 is maintained within the cavity 106 via frictional engagement.

In certain exemplary embodiments, the magazine retention device 100 includes a front sight 121 and/or a rear sight 122. Generally, the front sight 121 is positioned proximate the first end portion 101, while the rear sight 122 is positioned proximate the second end portion 102. The front sight 121 and the rear sight 122 are generally aligned along the longitudinal axis, $A_L$, of the magazine retention device 100. By including a front sight 121 and a rear sight 122, when the magazine retention device 100 is attached or coupled to a firearm or other device, as described herein, the magazine retention device 100 can provide primary or backup sights for the firearm or other device.

As illustrated, for example, in FIGS. 1-21, the front sight 121 and the rear sight 122 are formed as integral components of the magazine retention device 100 and extend from the body portion 103. The front sight 121 and the rear sight 122 generally extend from a top portion of the magazine retention device 100. It should be appreciated that the front sight 121 and/or the rear sight 122 may provide plain sights or may optionally include colored or illuminated portions, as is known in the art.

In certain other embodiments, as illustrated in FIGS. 22-24, one or more installation grooves 125 or installation recesses 126 are formed in a portion of the body portion 103 and/or the exterior wall portion(s) 104. The one or more installation grooves 125 generally comprise dovetail grooves, which allow known front or rear sights to be inserted within the installation grooves 125. One or more installation recesses 126 may alternatively be formed through or partially through a portion of the body portion 103 to allow for installation of certain sights, such as, for example, Glock style front sights.

In still other exemplary embodiments, as illustrated in FIG. 27, the front sight 121 and the rear sight 122 may be replaced by a sight channel 123. If included, the sight channel 123 is formed of a substantially squared or radiused "U" or "V" shaped groove, extending from the second end portion 102 to the first end portion 103. The sight channel 123 may or may not include a front sight positioned within a portion of the sight channel 123. The sight channel 123 is formed parallel to the longitudinal axis, $A_L$, of the magazine retention device 100. Thus, by viewing the target through the sight channel 123, the sight channel 123 can be used as an aiming device for the magazine retention device 100 and, in turn, an attached firearm or other device.

The attachment portion 130 extends from the body portion 103. In certain exemplary embodiments, the attachment portion 130 extends from the body portion 103 opposite the side from which the front sight 121 and the rear sight 122 extend. The attachment portion 130 allows the magazine retention device 100 to be attached or coupled to a desired firearm or other device. As illustrated, the attachment portion 130 may optionally include opposing attachment arms 132 having one or more pairs of opposing fastener apertures 134 formed therethrough. The one or more pairs of opposing fastener apertures 134 may optionally be formed substantially perpendicular to the longitudinal axis, $A_L$, of the magazine retention device 100.

The attachment arms 132 are formed so as to be attached or coupled to a portion of a rail element 140. The rail element 140 may comprise a picatinny or other similar rail element 140. As illustrated in FIGS. 16-17, the rail element 140 is attached or coupled to a firearm 160. It should be understood and appreciated that this is merely exemplary and the rail element 140 may be an independent element attached or coupled to a portion of a firearm or other device or may be formed as an integral component or extension of the firearm or other device.

The attachment portion 130 extends so as to allow the magazine retention device 100 to be attached or coupled to a rail element 140 so that the longitudinal axis, $A_L$, of the magazine retention device 100 is substantially parallel to a longitudinal axis, $A_L$, of the rail element 140 (and a barrel of the firearm 160).

When the attachment portion 130 is appropriately positioned relative to the rail element 140, the attachment arms 132 are positioned at least partially around an extension portion of the rail element 140. Frictional engagement between the attachment arms 132 and the rail element 140 may be sufficient to maintain the magazine retention device 100 in an appropriate position relative to the rail element 140.

In order to provide increased frictional engagement between the attachment arms 132 and the rail element 140, fastener elements 135 (such as, for example, a nut and screw) may be positioned through the aligned fastener apertures 134 (and aligned recoil grooves or recesses of the rail element 140). By tightening the fastener elements 135, the distance between the attachment arms 132 is decreased and increased frictional engagement is provided between the attachment arms 132 and the rail element 140.

As illustrated, for example, in FIGS. 18-19, a gap 108 is optionally provided in a portion of the body portion 103 (through both the exterior wall portion(s) 104 and the interior wall portion(s) 105), approximately between the attachment arms 132. If included, the gap 108 provides an additional degree of flex to the body portion 103, allowing a distance between the attachment arms 132 to be more easily increased (for installation or removal of the magazine retention device 100) and/or decreased (for further securing to a rail element 140).

The attachment portion 130 may comprise alternative attachment configurations, such as, for example, a quick disconnect type lever lock picatinny rail clamp, or other existing or later developed magazine retention devices are devices. Alternatively, the attachment portion 130 may comprise a Modular Lock (M-LOK) or KeyMod rail interface attachment. The attachment portion 130 may comprise a passive or active magazine retention device or device.

In various exemplary embodiments, the magazine retention device 100 is substantially rigid and is formed of a polymeric material such as a polymeric composite. Alternate materials of construction of the magazine retention device magazine retention device 100 may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

Thus, it should be understood that the material or materials used to form the magazine retention device 100 are generally substantially rigid, but are a design choice based on the desired appearance and functionality of the magazine retention device 100.

In certain exemplary embodiments, the magazine attachment device 100 may be formed as an integral unit. Alternatively, the magazine attention device 100 may be formed of at least two portions of material, wherein the body portion 103 and the attachment portion 130 are separate elements, and wherein the attachment portion 130 is attached or coupled to the body portion 103. Suitable materials can be used and sections or elements made independently and attached or coupled together, such as by adhesives, welding, screws, rivets, pins, or other fasteners, to form the various elements of the magazine attachment device.

FIGS. 16 and 17 illustrate exemplary attachment of one or more magazine retention devices 100 to an exemplary firearm 160. As illustrated, the firearm 160 includes a rail element 140, in the form of a handguard. As illustrated in FIG. 16, an exemplary magazine attachment device 100 is attached or coupled to the rail element 140 at the 12 o'clock position of the rail element 140. As illustrated in FIG. 17, an exemplary magazine attachment device 100 is attached or coupled to the rail element 140 at the 3 o'clock position of the rail element 140. Thus, it should be appreciated that one or more magazine attachment devices 100 may be attached at any desired rotational position or at any distance along the rail element 140.

As further illustrated, an optic 170 is also attached or coupled to the firearm 160. An exemplary magazine attachment device 100 is attached or coupled so as to provide backup sights to the firearm 160.

Because the attachment portion 130 extends parallel to the longitudinal axis, $A_L$, of the magazine retention device 100, the attachment portion 130 allows the magazine retention device 100 to be attached or coupled in a "forward" or "backward" configuration, making the magazine retention device 100 ambidextrous. If installation grooves 125 and/or installation recesses 126 are provided, the front sight and rear sight can be oriented in any desired position, relative to the first end portion 101 and the second end portion 102.

As illustrated in FIGS. 28-33, the magazine retention device 100 may optionally include a magazine retention lever 210. As illustrated, the magazine retention lever 210 is slidably positioned relative to the cavity 106. In certain exemplary embodiments, the magazine retention lever 210 comprises an elongate portion of material in the form of a rod or extended cylinder. The magazine retention lever 210 may optionally be positioned substantially perpendicular to the longitudinal axis, $A_L$, of the magazine retention device 100. Alternatively, the magazine retention lever 210 may optionally be positioned at a substantially acute or a substantially obtuse angle relative to the longitudinal axis, $A_L$, of the magazine retention device 100.

A spring biasing element 219, such as, for example, a compressible coil spring is positioned so as to provide a spring biasing force to the magazine retention lever 210. The spring biasing element 219 provides a spring biasing force to maintain the magazine retention lever 210 in an engaged position, as illustrated most clearly in FIGS. 28-32.

An extension tab 215 extends from a portion of the magazine retention lever 210, through an open engagement aperture 212 formed through a portion of the body portion 103, and extends into at least a portion of the cavity 106. In the spring biased, engaged position, at least a portion of the extension tab extends into the cavity 106. When the magazine retention lever 210 is urged to the disengaged position, as illustrated in FIG. 33, the extension tab 215 is at least partially withdrawn or fully withdrawn from the cavity 106. When the magazine retention lever 210 is released, the biasing force of the spring biasing element 219 urges the magazine retention lever 210 to return to its original, engaged position.

In various exemplary embodiments, the extension tab 215 includes a ramp surface that extends outward from the magazine retention lever 210 to a shoulder. The shoulder then returns to the surface of the magazine retention lever 210. In various exemplary embodiments, the shoulder includes a planar surface that extends approximately 90° relative to a planar surface formed by the magazine retention lever 210.

In various exemplary embodiments, an edge or transition between a terminal surface of the extension tab 215 and side surfaces of the extension tab 215 may be radiused or ramped. By providing a perpendicular (90°) edge or transition between a terminal surface of the extension tab 215 and a side surface of the extension tab 215, a portion of the extension tab 215 more positively engage the edge surfaces of the magazine release recess 152 of an inserted magazine 150. If an edge or transition between a terminal surface of the extension tab 215 and side surfaces of the extension tab 215 is at least partially radiused or ramped, contact between an edge surface of the magazine release recess 152 and an edge or transition of the extension tab 215 may allow the extension tab 215 to more easily slide along a terminal surface of the extension tab 215 and potentially urge the magazine retention lever 210 from the engaged position to the disengaged position, provided a sufficient amount of insertion force or removal force is applied to the magazine 150. Thus, by altering an edge or transition between a terminal surface of the extension tab 215 and side surfaces of the extension tab 215, the amount of insertion force or removal force required to transition the magazine retention lever 210 from the engaged position to the disengaged position may be altered, as desired.

A finger engagement portion 217 is formed to extend from the magazine retention lever 210 to provide better purchase of a user's finger on the magazine retention lever 210, to aid in urging the magazine retention lever 210 from the engaged position to the disengaged position.

During use, a user engages the finger engagement portion 217 and urges the finger engagement portion 217 toward the body portion 103. As the finger engagement portion 217 continues to be urged toward the body portion 103, the spring bias provided by the spring biasing element 219 is overcome and the magazine retention lever 210 may be urged from the engaged position to the disengaged position.

In various exemplary embodiments, as a magazine 150 is inserted into the cavity 106, a ramped surface or feature of the magazine 150 may initially engage the extension tab 215 and, as the magazine 150 continues to be inserted within the cavity 106, urge the extension tab 215 to the disengaged position, without manipulation of the finger engagement portion 217 or the magazine retention lever 210, by the user. Once the magazine 150 is appropriately positioned within the cavity 106, the extension tab 215 engages a magazine release recess 152. When the extension tab 115 engages the magazine release recess 152, the bias of the magazine retention lever 210 causes the magazine retention lever 210 to return to the engaged position and at least a portion of the extension tab 215 is maintained within the magazine release recess 152, thereby maintaining the magazine retention lever 210 in the engaged position.

FIGS. 34-36 illustrate exemplary embodiments of exemplary magazine attachment devices 200 and 300, which provide the features and elements of the magazine retention device 100, but provide more than one cavity 106. For example, the magazine attachment device 200 provides to horizontally adjacent cavities 106, while magazine attachment device 300 provides to vertically adjacent cavities 106. It should be appreciated that each of the features and/or elements, as described above, with reference to the magazine attachment device 100, may optionally be incorporated into the magazine attachment devices 200 and/or 300.

The front sight 121 and the rear sight 122 may optionally be included or attached, as described herein, to the magazine attachment device 200 or 300. As with the front sight 121 and the rear sight 122 in relation to the magazine attachment device 100, the front sight 121 and the rear sight 122 are positioned along the longitudinal axis, $A_L$.

While the present disclosure has been described in conjunction with the exemplary embodiments outlined above, the foregoing description of exemplary embodiments, as set forth above, are intended to be illustrative, not limiting and the disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A magazine retention device, comprising:

a body portion, wherein said body portion extends, along a longitudinal axis, from a first end portion to a second end portion, wherein one or more interior wall portion(s) define an at least partial cavity of said body portion, wherein said cavity is formed so as to receive at least a portion of a magazine at least partially therein, wherein said magazine is at least partially securable within at least a portion of said cavity by frictional engagement between one or more exterior surfaces of said magazine and at least a portion of said one or more interior wall portion(s), and wherein a front sight is positioned proximate said first end portion and a rear sight is positioned proximate said second end portion; and an attachment portion, wherein said attachment portion extends from said body portion to allow said magazine retention device to be attached or coupled to a rail element, such that said longitudinal axis of said magazine retention device is substantially parallel to a longitudinal axis of said rail element.

2. The magazine retention device of claim 1, wherein said first end portion is an open first end portion and said second end portion is an open second end portion, and wherein said cavity extends from said first end portion to said second end portion.

3. The magazine retention device of claim 1, wherein said cavity comprises a bottom wall portion and wherein said cavity extends from an open first end portion to said bottom wall portion.

4. The magazine retention device of claim 1, wherein said interior wall portion(s) are formed to provide at least some frictional engagement between one or more exterior surfaces of said magazine and one or more portions of said interior wall portion(s), when said magazine is appropriately positioned within said cavity.

5. The magazine retention device of claim 1, wherein at least one projection extends from one or more of said interior wall portion(s), into at least a portion of said cavity.

6. The magazine retention device of claim 1, wherein said front sight and said rear sight are aligned along said longitudinal axis of said magazine retention device.

7. The magazine retention device of claim 1, wherein said front sight and said rear sight are formed as integral components of said magazine retention device and extend from said body portion.

8. The magazine retention device of claim 1, wherein said front sight and said rear sight extend from a top portion of said magazine retention device.

9. The magazine retention device of claim 1, wherein one or more installation grooves and/or installation recesses are formed in a portion of said body portion to allow for installation of said front sight and/or said rear sight.

10. The magazine retention device of claim 1, wherein said attachment portion extends from said body portion opposite a side from which said front sight and said rear sight extend.

11. The magazine retention device of claim 1, wherein said attachment portion extends along said longitudinal axis of said magazine retention device.

12. The magazine retention device of claim 1, wherein said attachment portion comprises opposing attachment arms.

13. The magazine retention device of claim 12, wherein said attachment portion comprises one or more pairs of opposing fastener apertures formed therethrough, wherein each opposing pair of fastener apertures is formed substantially perpendicular to said longitudinal axis, wherein fastener elements are positionable through said aligned fastener apertures, such that when said fastening elements are tightened, a distance between said attachment arms is decreased.

14. The magazine retention device of claim 12, wherein a gap is provided in a portion of said body portion, between said attachment arms.

15. The magazine retention device of claim 1, wherein said attachment portion comprises a rail interface attachment.

16. The magazine retention device of claim 1, wherein said body portion and said attachment portion are formed as an integral unit.

17. The magazine retention device of claim 1, wherein said body portion is attached or coupled to said attachment portion.

18. The magazine retention device of claim 1, further comprising a flexible magazine retention lever, wherein said magazine retention lever is defined by an open channel, which extends through a portion of said body portion, wherein said magazine retention lever includes an extension tab that extends from said magazine retention lever and is operable to interact with a magazine release recess of a magazine, wherein said magazine retention lever is movable between an engaged position wherein at least a portion of said extension tab extends into said cavity and a disengaged position wherein at least a portion of said extension tab is withdrawn from said cavity, and wherein said magazine retention lever is naturally biased to said engaged position.

19. A magazine retention device, comprising:

a body portion, wherein said body portion extends, along a longitudinal axis, from a first end portion to a second end portion, wherein one or more interior wall portion(s) define a cavity of said body portion, wherein said first end portion is an open first end portion and said second end portion is an open second end portion, wherein said cavity extends from said first end portion to said second end portion and is formed so as to receive at least a portion of a magazine at least partially therein, wherein a flexible magazine retention lever is defined by an open channel, extending through a portion of said body portion, wherein said magazine retention lever includes an extension tab that extends from said magazine retention lever, wherein said magazine retention lever is movable between an engaged position wherein at least a portion of said extension tab extends into said cavity and a disengaged position wherein at least a portion of said extension tab is withdrawn from said cavity, wherein said magazine retention lever is naturally biased to said engaged position, and wherein a front sight is positioned proximate said first end portion and a rear sight is positioned proximate said second end portion; and an attachment portion, wherein said attachment portion extends from said body portion to allow said magazine retention device to be attached or coupled to a rail element, such that said longitudinal axis of said magazine retention device is substantially parallel to a longitudinal axis of said rail element.

20. A magazine retention device, comprising:

a body portion that extends along a longitudinal axis of said body portion, wherein at least one cavity is defined within said body portion, wherein said at least one cavity is operable to receive at least a portion of a magazine at least partially therein, wherein a front sight extends from said body portion and a rear sight extends from said body portion, and wherein said front sight and said rear sight are aligned substantially parallel to said longitudinal axis of said magazine retention device; and an attachment portion that extends from said body portion to allow said magazine retention device to be attached or coupled to a rail element, such that said longitudinal axis of said magazine retention device is substantially parallel to a longitudinal axis of said rail element.

* * * * *